US009779706B2

(12) United States Patent
Cogliati et al.

(10) Patent No.: US 9,779,706 B2
(45) Date of Patent: Oct. 3, 2017

(54) CONTEXT-DEPENDENT PIANO MUSIC TRANSCRIPTION WITH CONVOLUTIONAL SPARSE CODING

(71) Applicants: UNIVERSITY OF ROCHESTER, Rochester, NY (US); LOS ALAMOS NATIONAL SECURITY, LLC, Los Alamos, NM (US)

(72) Inventors: Andrea Cogliati, Rochester, NY (US); Zhiyao Duan, Penfield, NY (US); Brendt Egon Wohlberg, Santa Fe, NM (US)

(73) Assignees: University of Rochester, Rochester, NY (US); Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 15/046,724

(22) Filed: Feb. 18, 2016

(65) Prior Publication Data

US 2017/0243571 A1 Aug. 24, 2017

(51) Int. Cl.
*G10H 7/00* (2006.01)
*G10G 1/04* (2006.01)

(52) U.S. Cl.
CPC ..... *G10G 1/04* (2013.01); *G10H 2210/051* (2013.01); *G10H 2210/066* (2013.01); *G10H 2240/145* (2013.01); *G10H 2250/145* (2013.01)

(58) Field of Classification Search
CPC ..... G10G 1/04
USPC ..... 84/604
See application file for complete search history.

(56) References Cited

U.S. PATENT DOCUMENTS

2016/0093278 A1* 3/2016 Esparza ..... G10H 3/146 84/615

OTHER PUBLICATIONS

Marolt et al., Neural Networks for Note Onset Detection in Piano Music, 2002, In Proc. Int. Computer Music Conference, Gothenberg, vol. 4.*

Barker et al., Non-negative tensor factorisation of modulation spectrograms for monaural sound source separation, Proc. Interspeech, 2013, pp. 827-831.

(Continued)

*Primary Examiner* — Jianchun Qin

(74) *Attorney, Agent, or Firm* — Kilpatrick Townsend & Stockton, LLP

(57) ABSTRACT

The present disclosure presents a novel approach to automatic transcription of piano music in a context-dependent setting. Embodiments described herein may employ an efficient algorithm for convolutional sparse coding to approximate a music waveform as a summation of piano note waveforms convolved with associated temporal activations. The piano note waveforms may be pre-recorded for a particular piano that is to be transcribed and may optionally be pre-recorded in the specific environment where the piano performance is to be performed. During transcription, the note waveforms may be fixed and associated temporal activations may be estimated and post-processed to obtain the pitch and onset transcription. Experiments have shown that embodiments of the disclosure significantly outperform state-of-the-art music transcription methods trained in the same context-dependent setting, in both transcription accuracy and time precision, in various scenarios including synthetic, anechoic, noisy, and reverberant environments.

20 Claims, 12 Drawing Sheets

(56) References Cited

OTHER PUBLICATIONS

Benetos et al., A shift-invariant latent variable model for automatic music transcription, Computer Music Journal, vol. 36, Issue 4, 2012, pp. 81-94.
Benetos et al., Automatic music transcription: challenges and future directions, Journal of Intelligent Information Systems, vol. 41, Issue 3, Dec. 2013, pp. 407-434.
Benetos et al., Template adaptation for improving automatic music transcription, Proc. of ISMIR 2014, 2014, pp. 175-180.
Blumensath et al., Sparse and shift-invariant representations of music, IEEE Transactions on Audio, Speech, and Language Processing, vol. 14, Issue 1, Jan. 2006, pp. 50-57.
Chen et al., Atomic decomposition by basis pursuit, SIAM journal on scientific computing, vol. 20, Issue 1, 1998, pp. 33-61.
Cheng et al., Modelling the decay of piano sounds, Proc. of the IEEE International Conference on Acoustics, Speech, and Signal Processing (ICASSP), Brisbane, Australia, Apr. 19-24, 2015, pp. 594-598.
Cheveigne et al., YIN, a fundamental frequency estimator for speech and music, The Journal of the Acoustical Society of America, vol. 11, Issue 4, Apr. 2002, pp. 1917-1930.
Cogliati et al., Piano music transcription modeling note temporal evolution, Proc. of the IEEE International Conference on Acoustics, Speech, and Signal Processing (ICASSP), Brisbane, Australia, 2015, pp. 429-433.
Emiya et al., Multi-pitch estimation of piano sounds using a new probabilistic spectral smoothness principle, IEEE Transactions on Audio, Speech, and Language Processing, vol. 18, Issue 6, Aug. 2010, pp. 1643-1654.
Ewert et al., A dynamic programming variant of non-negative matrix deconvolution for the transcription of struck string instruments, Proc. of the IEEE International Conference on Acoustics, Speech, and Signal Processing (ICASSP), Brisbane, Australia, Apr. 19-24, 2015, pp. 569-573.
Grindlay et al., Transcribing multi-instrument polyphonic music with hierarchical eigeninstruments, IEEE Journal of Selected Topics in Signal Processing, vol. 5, Issue 6, Oct. 2011, pp. 1159-1169.
Grosse et al., Shift-invariant sparse coding for audio classification, Cortex, arXiv preprint arXiv:1206.5241, Jun. 2012, 10 pages.
Jao et al., Informed monaural source separation of music based on convolutional sparse coding, Proc. of IEEE International Conference on Acoustics, Speech, and Signal Processing (ICASSP), Brisbane, Australia, Apr. 19-24, 2015, pp. 236-240.
Lee et al., Algorithms for nonnegative matrix factorization, Proc. Advances in Neural Information Processing Systems, 2001, pp. 556-562.
Lee et al., Learning the parts of objects by non-negative matrix factorization, Nature, vol. 401, No. 6755, Oct. 21, 1999, pp. 788-791.
Lee et al., Multi-pitch estimation of piano music by exemplar-based sparse representation, IEEE Transactions on Multimedia, vol. 14, Issue 3, Mar. 20, 2012, pp. 608-618.
Mysore et al., Non-negative hidden markov modeling of audio with application to source separation, Springer, Latent Variable Analysis and Signal Separation, 2010, pp. 140-148.
Nikunen et al., Multichannel audio upmixing based on non-negative tensor factorization representation, Proc. IEEE Workshop on Applications of Signal Processing to Audio and Acoustics (WASPAA), Oct. 16-19, 2011, pp. 33-36.
O'Hanlon et al., Polyphonic piano transcription using non-negative matrix factorisation with group sparsity, Proc. of IEEE International Conference On Acoustics, Speech, and Signal Processing (ICASSP). IEEE, May 4-9, 2014, pp. 3136-3140.
Plumbley et al., Sparse representations of polyphonic music, Signal Processing, vol. 86, Issue 3, 2006, pp. 417-431.
Smaragdis et al., A probabilistic latent variable model for acoustic modeling, Workshop on Advances in Models for Acoustic Processing at NIPS, 2006, 6 pages.
Smaragdis, Non-negative matrix factor deconvolution; extraction of multiple sound sources from monophonic inputs, Springer, Independent Component Analysis and Blind Signal Separation, vol. 3195, Sep. 2004, pp. 494-499.
Smaragdis et al., Non-negative matrix factorization for polyphonic music transcription, IEEE, Applications of Signal Processing to Audio and Acoustics,, Oct. 19-22, 2003, pp. 177-180.
Virtanen, Monaural sound source separation by nonnegative matrix factorization with temporal continuity and sparseness criteria, IEEE Transactions on Audio, Speech, and Language Processing, vol. 15, Issue 3, Feb. 20, 2007, pp. 1066-1074.
Wohlberg, Efficient convolutional sparse coding, Proc. of IEEE International Conference on Acoustics, Speech, and Signal Processing (ICASSP), Florence, Italy, May 4-9, 2014, pp. 7173-7177.
Zeiler et al., Deconvolutional networks, IEEE, Computer Vision and Pattern Recognition (CVPR), 2010, 2010, pp. 2528-2535.
Abdallah, et al., "Polyphonic music transcription by non-negative sparse coding of power spectra," in *5th International Conference on Music Information Retrieval* (*ISMIR*), pp. 318-325 (2004).
Bay, et al., "Evaluation of multiple-f0 estimation and tracking systems." in *Proc. ISMIR*, pp. 315-320 (2009).
Bello, et al., "A tutorial on onset detection in music signals," *IEEE Transactions on Speech and Audio Processing*, vol. 13, No. 5, pp. 1035-1047, (2005).
Bello, et al., "Automatic piano transcription using frequency and time-domain information," *IEEE Transactions on Audio, Speech, and Language Processing*, vol. 14, No. 6, pp. 2242-2251, (2006).
Berg-Kirkpatrick, et al., "Unsupervised transcription of piano music," in *Advances in Neural Information Processing Systems*, pp. 1538-1546 (2014).
Böck, et al., "Polyphonic piano note transcription with recurrent neural networks," in *IEEE International Conference on Audio, Speech, and Signal Processing*, pp. 121-124 (Mar. 2012).
Boulanger-Lewandowski, et al., "Modeling temporal dependencies in high-dimensional sequences: Application to polyphonic music generation and transcription," in *29th International Conference on Machine Learning*, Edinburgh, Scotland, UK, (2012).
Boyd, et al., "Distributed optimization and statistical learning via the alternating direction method of multipliers," *Foundations and Trends in Machine Learning*, vol. 3, No. 1, pp. 1-122, (2011).
Bristow, et al., "Fast convolutional sparse coding," in *Computer Vision and Pattern Recognition* (*CVPR*), *2013 IEEE Conference on*, pp. 391-398 (2013).
Cemgil, et al., "A generative model for music transcription," *IEEE Transactions on Audio, Speech, and Language Processing*, vol. 14, No. 2, pp. 679-694, (Mar. 2006).
Cogliati, et al., "Piano music transcription with fast convolutional sparse coding," in *Machine Learning for Signal Processing* (*MLSP*), *2015 IEEE 25th International Workshop on*, pp. 1-6 (Sep. 2015).
Costantini, et al., "Event based transcription system for polyphonic piano music," *Signal Processing*, vol. 89, No. 9, pp. 1798-1811, (2009).
Davy, et al., "Bayesian analysis of polyphonic western tonal music," *The Journal of the Acoustical Society of America*, vol. 119, No. 4, pp. 2498-2517, (2006).
Dressler, "Multiple fundamental frequency extraction for MIREX 2012," *Eighth Music Information Retrieval Evaluation eXchange* (*MIREX*), (2012).
Duan, et al., "Note-level music transcription by maximum likelihood sampling," in *International Symposium on Music Information Retrieval Conference*, (Oct. 2001).
Duan, et al., "Multiple fundamental frequency estimation by modeling spectral peaks and non-peak regions," *Audio, Speech, and Language Processing, IEEE Transactions on*, vol. 18, No. 8, pp. 2121-2133, (2010).
Gabor, "Theory of communication. part 1: The analysis of information," *Journal of the Institution of Electrical Engineers—Part III: Radio and Communication Engineering*, vol. 93, No. 26, pp. 429-441, (1946).
Goto, "A real-time music-scene-description system: Predominant-f0 estimation for detecting melody and bass lines in real-world audio signals," *Speech Communication*, vol. 43, No. 4, pp. 311-329, (2004).

(56) References Cited

OTHER PUBLICATIONS

Grosse, et al., "Shift-invariance sparse coding for audio classification," *arXiv preprint arXiv:1206.5241*, (2012).
Jao, et al., "Informed monaural source separation of music based on convolutional sparse coding," in *Proc. of IEEE International Conference on Acoustics, Speech, and Signal Processing* (*ICASSP*), Brisbane, Australia, pp. 236-240 (Apr. 2015).
Kameoka, et al., "A multipitch analyzer based on harmonic temporal structured clustering," *IEEE Transactions on Audio, Speech, and Language Processing*, vol. 15, No. 3, pp. 982-994, (2007).
Klapuri, "Multiple fundamental frequency estimation based on harmonicity and spectral smoothness," IEEE Transactions on Speech and Audio Processing, vol. 11, No. 6, pp. 804-816, (2003).
Marolt, et al., "Neural networks for note onset detection in piano music," in *Proc. International Computer Music Conference*, Conference Proceedings (2002).
Meddis, et al., "Virtual pitch and phase sensitivity of a computer model of the auditory periphery. i: pitch identification," *Journal of the Acoustical Society of America*, vol. 89, pp. 2866-2882, (1991).
Moorer, "On the transcription of musical sound by computer," *Computer Music Journal*, pp. 32-38, (1977).
Nam, et al., "A classification-based polyphonic piano transcription approach using learned feature represen-tations." in Proc. ISMIR, pp. 175-180 (2011).
O'Hanlon, et al., "Structured sparsity for automatic music transcription," in *Proc. of IEEE International Conference on Acoustics, Speech, and Signal Processing* (*ICASSP*), pp. 441-444 (2012).
Peeling, et al., "Multiple pitch estimation using non-homogeneous poisson processes," *IEEE Journal of Selected Topics in Signal Processing*, vol. 5, No. 6, pp. 1133-1143, (Oct. 2011).
Pertusa, et al., "Multiple fundamental frequency estimation using Gaussian smoothness," in *IEEE International Conference on Audio, Speech, and Signal Processing*, pp. 105-108 (Apr. 2008).
Piszczalski, et al., "Automatic music transcription," *Computer Music Journal*, vol. 1, No. 4, pp. 24-31, (1977).
Poliner, et al., "A discriminative model for polyphonic piano transcription," *EURASIP Journal on Advances in Signal Processing*, No. 8, pp. 154-162, (Jan. 2007).
Raphael, et al., "Automatic transcription of piano music." in *Proc. ISMIR*, (2002).
Ryynänen, et al., "Automatic transcription of melody, bass line, and chords in polyphonic music," *Computer Music Journal*, vol. 32, No. 3, pp. 72-86, (2008).
Saito, et al., "Specmurt analysis of polyphonic music signals," *IEEE Transactions on Audio, Speech, and Language Processing*, vol. 16, No. 3, pp. 639-650, (Mar. 2008).
Sigtia, et al., "A hybrid recurrent neural network for music transcription," in *IEEE International Conference on Acoustics, Speech, and Signal Processing*, Brisbane, Australia, pp. 2061-2065 (Apr. 2015).
Su, et al., "Combining spectral and temporal representations for multipitch estimation of polyphonic music," *IEEE/ACM Transactions on Audio, Speech and Language Processing*, vol. 23, No. 10, pp. 1600-1612, (Oct. 2015).
Suzuki, et al., "Acoustics of pianos," *Applied Acoustics*, vol. 30, No. 2, pp. 147-205, [Online]. Available: http://www.sciencedirect.com/science/article/pii/0003682X9090043T. (1990).
Tolonen, et al., "A computationally efficient multipitch analysis model," *IEEE Transactions on Speech and Audio Processing*, vol. 8, No. 6, pp. 708-716, Nov. (2000).
Walmsley, et al., "Polyphonic pitch tracking using joint bayesian estimation of multiple frame parameters," in *Applications of Signal Processing to Audio and Acoustics, 1999 IEEE Workshop on*. IEEE, pp. 119-122 (1999).
Wohlberg, "SParse Optimization Research COde (SPORCO)," Matlab library available from http://math.lanl.gov/~brendt/Software/SPORCO/, version 0.0.2. (2015).
Yeh, et al., "Multiple fundamental frequency estimation of polyphonic music signals," in *Proc. of IEEE International Conference on Acoustics, Speech, and Signal Processing* (*ICASSP*), vol. 3, pp. iii-225 (2005).

* cited by examiner

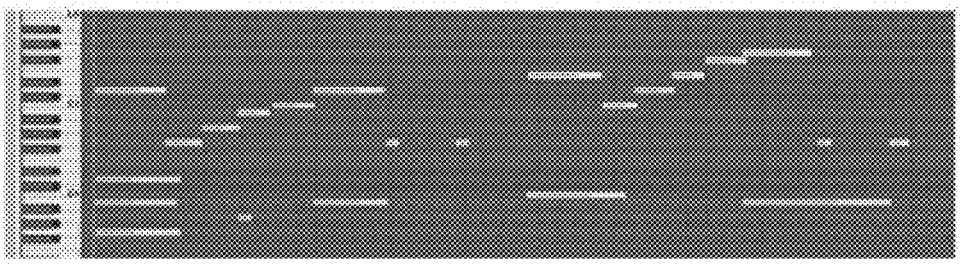
Figure 4: Ground truth piano roll
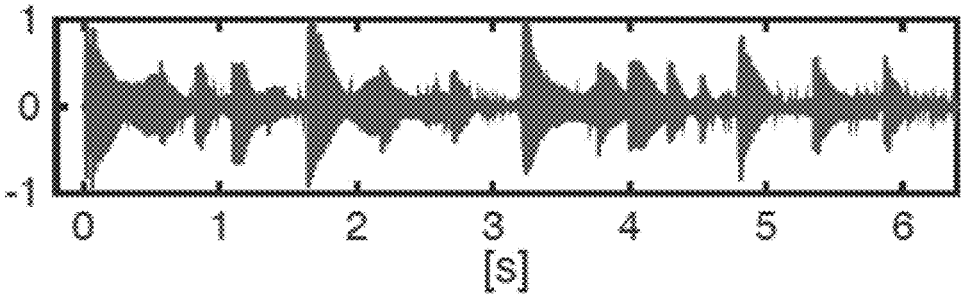
Figure 5: Waveform

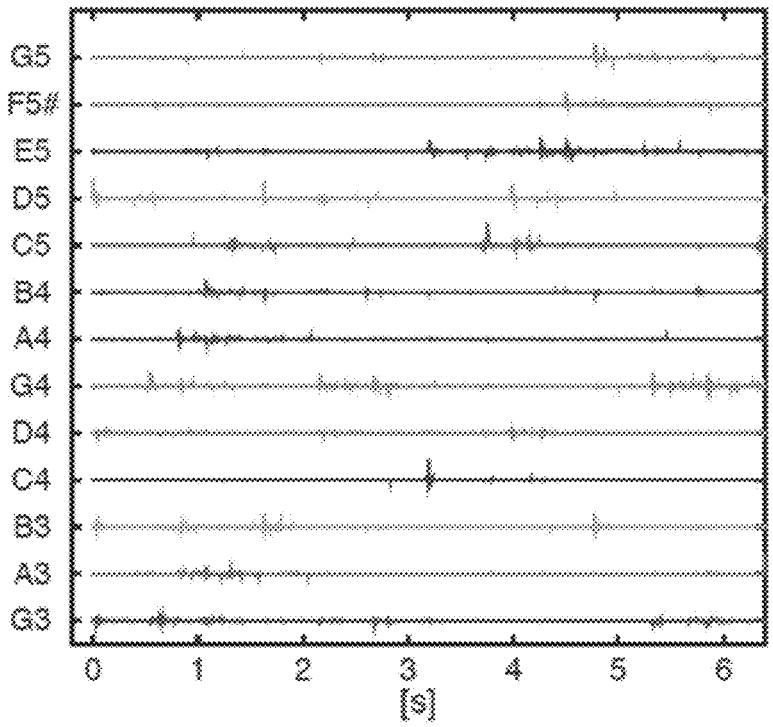
Figure 6: Raw activations
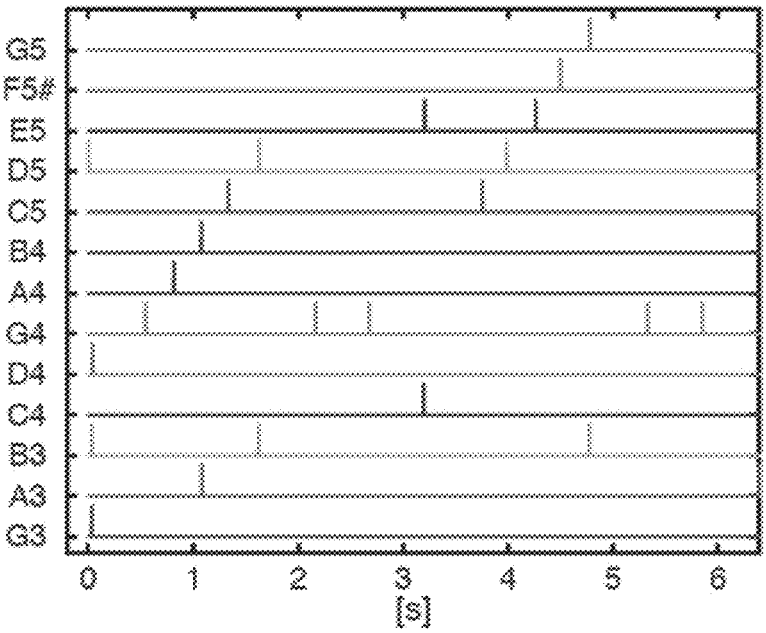
Figure 7: Binarized Activations

| Octave | Notes | # of notes |
|---|---|---|
| 1 | A0-B1 | 74 |
| 2 | C2-B2 | 497 |
| 3 | C3-B3 | 1,822 |
| 4 | C4-B4 | 2,568 |
| 5 | C5-B5 | 2,035 |
| 6 | C6-B6 | 302 |
| 7 | C7-C8 | 57 |

TABLE I
NOTES IN THE GROUND TRUTH PER OCTAVE.

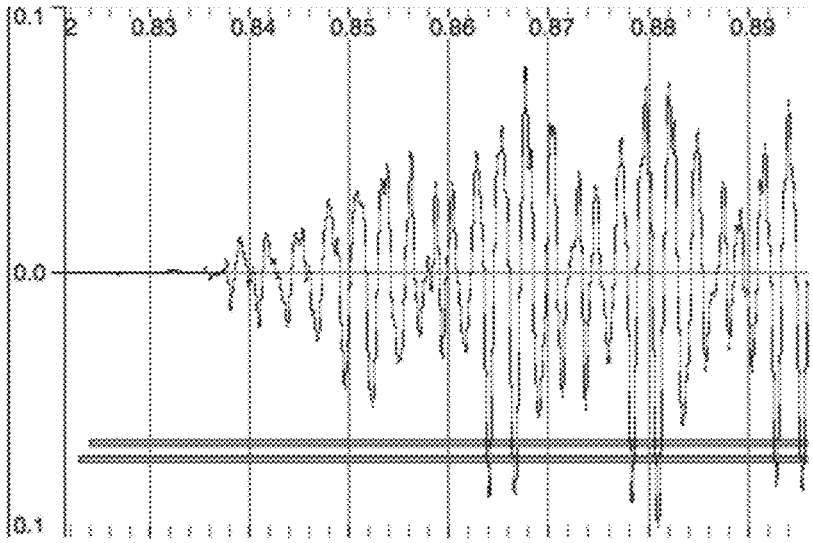
Figure 18A. Debussy's Claire de Lune (deb_cla) from ENSTDkCl.
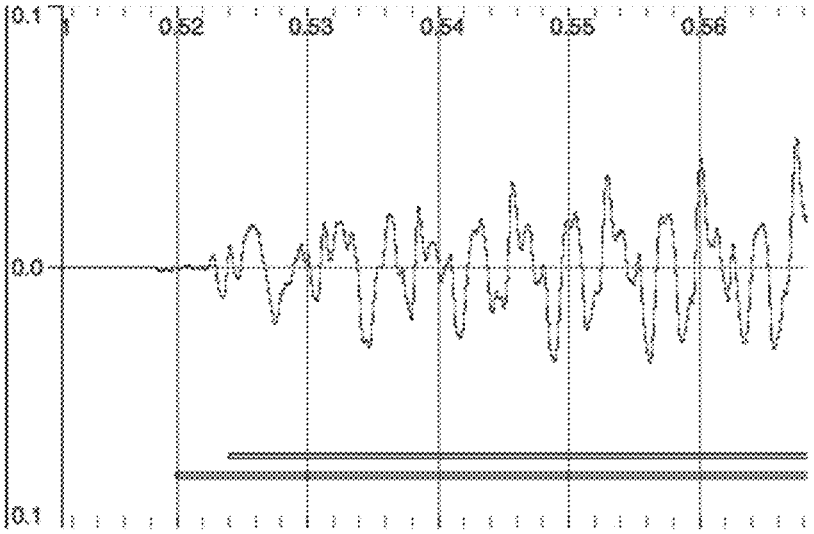
Figure 18B. Borodin's Piano Sonata 6 (bor_ps6) from ENSTDkCl.

CONTEXT-DEPENDENT PIANO MUSIC TRANSCRIPTION WITH CONVOLUTIONAL SPARSE CODING

STATEMENT REGARDING FEDERALLY FUNDED RESEARCH

This invention was made with government support under DE-AC52-06NA25396 awarded by the Department of Energy. The government has certain rights in the invention.

BACKGROUND

Described below are systems and methods for transcribing piano music. Particular embodiments may employ an efficient algorithm for convolution sparse coding to transcribe the piano music.

Automatic music transcription (AMT) is the process of automatically inferring a high-level symbolic representation, such as music notation or piano-roll, from a music performance [1]. It has several applications in music education (e.g., providing feedback to a piano learner), content-based music search (e.g., searching songs with similar bassline), musicological analysis of non-notated music (e.g., Jazz improvisations and non-western music), and music enjoyment (e.g., visualizing the music content).

Music transcription of polyphonic music is a challenging task even for humans. It is related to ear training, a required course for professional musicians on identifying pitches, intervals, chords, melodies, rhythms, and instruments of music solely by hearing. AMT for polyphonic music was first proposed in 1977 by Moorer [2], and Piszczalski and Galler [3]. Despite almost four decades of active research, it is still an open problem and current AMT systems and methods cannot match human performance in either accuracy or robustness [1].

A problem of music transcription is figuring out which notes are played and when they are played in a piece of music. This is also called note-level transcription [4]. A note produced by a pitched musical instrument has three basic attributes: pitch, onset, and offset. Pitch is a perceptual attribute but can be reliably related to the fundamental frequency (F0) of a harmonic or quasi-harmonic sound [5]. Onset refers to the beginning time of a note, in which amplitude of the note increases from zero to an audible level. This increase is very sharp for percussive pitched instruments such as piano. Offset refers to the ending time of a note, when the waveform of the note vanishes.

In the literature, the problems of pitch estimation and onset detection are often addressed separately and then combined to achieve note-level transcription. For onset detection, commonly used methods are based on spectral energy changes in successive frames [6]. These methods do not model the harmonic relation of frequencies that have this change, or the temporal evolution of partial energy of notes. Therefore, these methods tend to miss onsets of soft notes in polyphonic pieces and detect false positives due to local partial amplitude fluctuations caused by overlapping harmonics or reverberation.

Pitch estimation in monophonic music is considered a solved problem [7]. In contrast, polyphonic pitch estimation is much more challenging because of the complex interaction (e.g., overlapping harmonics) of multiple simultaneous notes. To properly identify all the concurrent pitches, the partials of the mixture must be separated and grouped into clusters belonging to different notes. Most multi-pitched analysis methods operate in the frequency domain with a time-frequency magnitude representation [1]. This approach has two fundamental limitations: it introduces the time-frequency resolution trade-off due to the Gabor limit [8], and it discards the phase, which may contain useful cues for the harmonic fusing of partials [5]. These two limitations generally lead to low accuracy for practical purposes, with state-of-the-art results below 70% as evaluated by MIREX 2015 on orchestral pieces with up to five instruments and piano pieces.

There are, in general, three approaches to note-level music transcription. Frame-based approaches estimate pitches in each individual time frame and then form notes in a postprocessing stage. Onset-based approaches first detect onsets and then estimate pitches within each inter-onset interval. Note-based approaches estimate notes including pitches and onsets directly.

A. Frame-Based Approach

Frame-level multi-pitch estimation (MPE) is the key component of this approach. The majority of recently proposed MPE methods operate in the frequency domain. One group of methods analyze or classify features extracted from the time-frequency representation of the audio input [1]. Raphael [10] used a Hidden Markov Model (HMM) in which the states represent note combinations and the observations are spectral features, such as energy, spectral flux, and mean and variance of each frequency band. Klapuri [11] used an iterative spectral subtraction approach to estimate a predominant pitch and subtract its harmonics from the mixture in each iteration. Yeh et al. [12] jointly estimated pitches based on three physical principles—harmonicity, spectral smoothness and synchronous amplitude evolution. More recently, Dressler [13] used a multi-resolution Short Time Fourier Transform (STFT) in which the magnitude of each bin is multiplied by the bin's instantaneous frequency. The pitch estimation is done by detecting peaks in the weighted spectrum and scoring them by harmonicity, spectral smoothness, presence of intermediate peaks and harmonic number. Poliner and Ellis [14] used support vector machines (SVM) to classify the presence of notes from the audio spectrum. Pertusa and Iesta [15] identified pitch candidates from spectral analysis of each frame, then selected the best combinations by applying a set of rules based on harmonic amplitudes and spectral smoothness. Saito et al. [16] applied a specmurt analysis by assuming a common harmonic structure of all the notes in each frame. Finally, methods based on deep neural networks are beginning to appear [17]-[20].

Another group of MPE methods are based on statistical frameworks. Goto [21] viewed the mixture spectrum as a probability distribution and modeled it with a mixture of tied-Gaussian mixture models. Duan et al. [22] and Emiya et al. [23] proposed Maximum-Likelihood (ML) approaches to model spectral peaks and non-peak regions of the spectrum. Peeling and Godsill [24] used non-homogenous Poisson processes to model the number of partials in the spectrum.

A popular group of MPE methods in recent years are based on spectrogram factorization techniques, such as Nonnegative Matrix Factorization (NMF) [25] or Probabilistic Latent Component Analysis (PLCA) [26]; the two methods are mathematically equivalent when the approximation is measured by Kullback-Leibler (KL) divergence. The first application of spectrogram factorization techniques to AMT was performed by Smaragdis and Brown [27]. Since then, many extensions and improvements have been proposed. Grindlay et al. [28] used the notion of eigeninstruments to model spectral templates as a linear combination of basic instrument models. Benetos et al. [29] extended PLCA by incorporating shifting across log-frequency to account for vibrato, i.e., frequency modulation. Abdallah et al. [30] imposed sparsity on the activation weights. O'Hanlon et al. [31], [32] used structured sparsity, also called group sparsity, to enforce harmonicity of the spectral bases.

Time domain methods are far less common than frequency domain methods for multi-pitch estimation. Early AMT methods operating in the time domain attempted to simulate the human auditory system with bandpass filters and autocorrelations [33], [34]. More recently, other researchers proposed time-domain probabilistic approaches based on Bayesian models [35]-[37]. Plumbley et al. [38] proposed and compared two approaches for sparse decomposition of polyphonic music, one in the time domain and the other in the frequency domain, however a complete transcription system was not demonstrated due to the necessity of manually annotating atoms, and the system was only evaluated on very short music excerpts, possibly because of the high computational requirements. Bello et al. [39] proposed a hybrid approach exploiting both frequency and time-domain information. More recently, Su and Yang [40] also combined information from spectral (harmonic series) and temporal (subharmonic series) representations.

To obtain a note-level transcription from frame-level pitch estimates, a post-processing step, such as a median filter [40] or a HMM [41], is often employed to connect pitch estimates across time into notes and remove isolated spurious pitches. These operations are performed on each note independently. To consider interactions of simultaneous notes, Duan and Temperley [42] proposed a maximum likelihood sampling approach to further refine the preliminary note tracking results.

B. Onset-Based Approach

In onset-based approaches, a separate onset detection stage is used during the transcription process. This approach is often adopted for transcribing piano music, given the relative prominence of onsets compared to other types of instruments. SONIC, a piano music transcription by Marolt et al., used an onset detection stage to refine the results of neural network classifiers [43]. Costantini et al. [44] proposed a piano music transcription method with an initial onset detection stage to detect note onsets; a single CQT window of the 64 ms following the note attack is used to estimate the pitches with a multi-class SVM classification. Cogliati and Duan [45] proposed a piano music transcription method with an initial onset detection stage followed by a greedy search algorithm to estimate the pitches between two successive onsets. This method models the entire temporal evolution of piano notes.

C. Note-Based Approach

Note-based approaches combine the estimation of pitches and onsets (and possibly offsets) into a single framework. While this increases the complexity of the model, it has the benefit of integrating the pitch information and the onset information for both tasks. As an extension to Goto's statistical method [21], Kameoka et al. [46] used so-called harmonic temporal structured clustering to jointly estimate pitches, onsets, offsets and dynamics. Berg-Kirkpatrick et al. [47] combined an NMF-like approach in which each note is modeled by a spectral profile and an activation envelope with a two-state HMM to estimate play and rest states. Ewert et al. [48] modeled each note as a series of states, each state being a log-magnitude frame, and used a greedy algorithm to estimate the activations of the states.

As set forth above, despite almost four decades of active research, still further improvements may be desired.

SUMMARY OF THE DISCLOSURE

Embodiments of the present disclosure provide a novel approach to automatic transcription of piano music in a context-dependent setting. Embodiments described herein may employ an efficient algorithm for convolutional sparse coding to approximate a music waveform as a summation of piano note waveforms (sometimes referred to herein as dictionary elements or atoms) convolved with associated temporal activations (e.g., onset transcription). The piano note waveforms may be pre-recorded for a particular piano that is to be transcribed and may optionally be pre-recorded in the specific environment where the piano performance is to be performed. During transcription, the note waveforms may be fixed and associated temporal activations may be estimated and post-processed to obtain the pitch and onset transcription. Embodiments disclosed herein may work in the time domain, model temporal evolution of piano notes, and may estimate pitches and onsets simultaneously in the same framework. Experiments have shown that embodiments of the disclosure significantly outperform state-of-the-art music transcription methods trained in the same context-dependent setting, in both transcription accuracy and time precision, in various scenarios including synthetic, anechoic, noisy, and reverberant environments.

In some aspects of the present disclosure, a method of transcribing a musical performance played on an instrument, such as a piano may be provided. The method may include recording a plurality of waveforms. Each of the plurality of waveforms may be associated with a key of the piano. The musical performance played on the piano may be recorded. A plurality of activation vectors associated with the recorded performance may be determined using the plurality of recorded waveforms. Local maxima from the plurality of activation vectors may be determined. Note onsets may be inferred from the detected local maxima. Thereafter, the inferred note onsets and the determined plurality of activation vectors may be outputted.

In some embodiments, the plurality of recorded waveforms may be associated with each individual piano note of the piano. Optionally, the plurality of recorded waveforms each have a duration of 0.5 seconds or more (e.g., 0.5-2 seconds, 1 second, etc.).

In certain embodiments, the plurality of activation vectors may be determined using a convolutional sparse coding algorithm. The step of detecting local maxima from the plurality of activation vectors may include discarding subsequent maxima following an initial local maxima that are within a predetermined time window. The predetermined time window may be at least 50 ms in duration in some embodiments.

Optionally, the step of detecting local maxima from the plurality of activation vectors includes discarding local maxima that are below a threshold that is associated with a highest peak in the plurality of activation vectors. In some embodiments, the threshold may be 10% of the highest peak in the plurality of activation vectors such that local maxima that are 10% or less than the highest peak in the plurality of activation vectors are discarded. Optionally, in some embodiments, the threshold may be 1%-15% of the highest peak.

In further aspects of the present invention, a system for transcribing a musical performance played on a piano may be provided. The system may include an audio recorder for recording a plurality of waveforms or otherwise training a dictionary of elements. The plurality of waveforms may each be associated with a key of the piano to be transcribed, or a different audio recorder may be used for the musical performance to be transcribed. The audio recorder may also be for recording the musical performance played on the piano. A non-transitory computer-readable storage medium (computer memory) may be operably coupled with the audio recorder for storing the plurality of waveforms associated with the keys of the piano and for storing the musical performance played on the piano. A computer processor may be operably coupled with the non-transitory computer-readable storage medium and configured to: determine a plurality of activation vectors associated with the stored piano performance using the plurality of stored waveforms; detect local maxima from the plurality of activation vectors; infer note onsets from the detected local maxima; and/or output the inferred note onsets and the determined plurality of activation vectors.

The plurality of stored waveforms may be associated with all individual piano notes of the piano. The plurality of stored waveforms may each have a duration of 0.5 seconds or more (e.g., 0.5-2 seconds, 1 second, etc.).

Optionally, the activation vectors may be determined by the computer processor using a convolutional sparse coding algorithm. In certain embodiments, the computer processor may detect local maxima from the plurality of activation vectors by discarding subsequent maxima following an initial local maxima that are within a predetermined time window. In some cases, the predetermined time window may be at least 50 ms.

In some embodiments, the computer processor may detect local maxima from the plurality of activation vectors by discarding local maxima that are below a threshold that is associated with a highest peak in the plurality of activation vectors. The threshold may be 10% of the highest peak in the plurality of activation vectors such that local maxima that are 10% or less than the highest peak in the plurality of activation vectors are discarded.

In further aspects of the present invention, a non-transitory computer-readable storage medium may be provided that includes a set of computer executable instructions for transcribing a musical performance played on a piano. Execution of the instructions by a computer processor may cause the computer processor to carry out the steps of: recording a plurality of waveforms associated with keys of the piano; recording the musical performance played on the piano; determining a plurality of activation vectors associated with the recorded performance using the plurality of recorded waveforms; detecting local maxima from the plurality of activation vectors; inferring note onsets from the detected local maxima; and outputting the inferred note onsets and the determined plurality of activation vectors.

The plurality of activation vectors may be determined using a convolutional sparse coding algorithm. The local maxima may be detected from the plurality of activation vectors by discarding local maxima that are below a threshold that is associated with a highest peak in the plurality of activation vectors. Optionally, local maxima are detected from the plurality of activation vectors by discarding subsequent maxima following an initial local maxima that are within a predetermined time window.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The invention will be better understood upon reading the following description and examining the figures which accompany it. These figures are provided by way of illustration only and are in no way limiting on the invention.

BRIEF DESCRIPTION OF THE DRAWINGS

FIG. 4 illustrates an exemplary piano roll that may represent the ground-truth according to some embodiments;

FIG. 5 illustrates an audio waveform associated with the piano roll of FIG. 4;

FIG. 6 illustrates raw activation vectors associated with the waveform of FIG. 5 that are estimated using methods of the present disclosure;

FIG. 7 illustrates note onsets inferred from the raw activation vectors of FIG. 6 according to some embodiments;

FIGS. 18A-18B illustrates two pieces from the ENSTDkCl collection in MAPS showing different alignments between audio and ground truth MIDI notes (red bars).

DETAILED DESCRIPTION OF THE DISCLOSURE

The subject matter of embodiments of the present invention is described here with specificity, but the claimed subject matter may be embodied in other ways, may include different elements or steps, and may be used in conjunction with other existing or future technologies. While the below embodiments are described in the context of automated transcription of a piano performance, those of skill in the art will recognize that the systems and methods described herein can also transcribe performance by another instrument or instruments.

Figure 1:
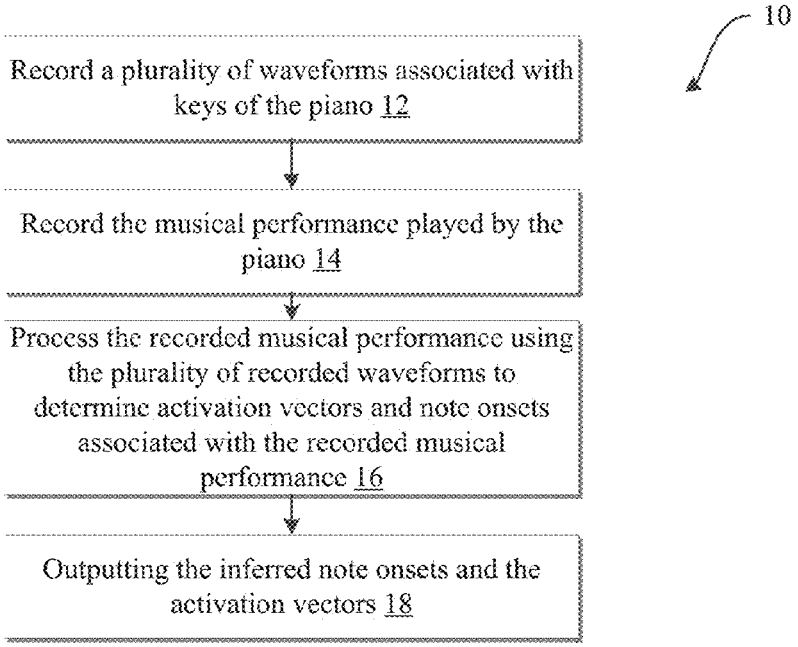
FIG. 1 illustrates an exemplary method of transcribing a piano performance according to some embodiments of the present disclosure.

FIG. 1 illustrates an exemplary method 10 for transcribing a piano performance. At step 12, a plurality of waveforms associated with keys of the piano may be sampled or recorded (e.g., for dictionary training). At step 14, a musical performance played by the piano may be recorded. At step 16, the recorded musical performance may be processed using the plurality of recorded waveforms to determine activation vectors and note onsets associated with the recorded musical performance. At step 18, the inferred note onsets and the activation vectors may be outputted.

The present disclosure describes a novel time-domain approach for transcribing polyphonic piano performances at the note-level. More specifically, the piano audio waveform may be modeled as a convolution of note waveforms (i.e., dictionary templates) and their activation weights (i.e., transcription of note onsets). Embodiments of the disclosure are useful for musicians, both professionals and amateurs, to transcribe their performances with much higher accuracy than state-of-the-art approaches. Compared to current state-of-the-art AMT approaches, embodiments of the disclosure may have one or more of the following advantages:

The transcription may be performed in the time domain and may avoid the time-frequency resolution trade-off by imposing structural constraints on the analyzed signal—i.e., a context specific dictionary and sparsity on the atom activations—resulting in better performance, especially for low-pitched notes;

Temporal evolution of piano notes may be modeled and pitch and onset may be estimated simultaneously in the same framework;

A much higher transcription accuracy and time precision may be achieved compared to a state-of-the-art AMT approach;

Embodiments may work in reverberant environments and may be robust to stationary noise to a certain degree.

As set forth above, a monaural, polyphonic piano audio recording, s(t), may be approximated with a sum of dictionary elements, $d_m(t)$, representing the waveform of each individual note of the piano, convolved with their activation vectors, $x_m(t)$:

$$s(t) \approx \Sigma_m d_m(t) * x_m(t). \quad (1)$$

The dictionary elements, $d_m(t)$, may be pre-set by sampling 12 the individual notes of a piano (e.g., all or a portion thereof) and may be fixed during transcription. In some embodiments, the dictionary elements may be pre-learned in a supervised manner by sampling 12 each individual note of a piano at a certain dynamic level, e.g., forte (80-91 dB sound pressure level (SPL) at 10 feet away from the piano), for 1 s. For example, in certain experimental implementations, a sampling frequency of 11,025 Hz was used to reduce the computational workload. The length of sampling may be selected by a parameter search. The choice of the dynamic level is not critical, however, louder dynamics may produce better results than softer dynamics, in certain embodiments. This may be due to the higher signal-to-noise and signal-to-quantization noise ratios of the louder note templates. Softer dynamics in music notation may include piano and mezzo piano (mp). Their intensity ranges may be 44-55 dB SPL and 55-67 dB SPL, respectively.

Another possible reason may be the richer spectral content of louder note templates. When trying to approximate a soft note with a louder template, the reconstructed signal may contain extra partials that are cancelled by negative activations of other notes to lower the data fidelity error. On the other hand, when trying to reconstruct a loud note with a softer template, the reconstructed signal may lack partials that need to be introduced with positive activations of other notes to increase the data fidelity. Optionally, embodiments described herein may be configured to only consider positive activations so negative activations do not introduce transcription errors, while positive activations might introduce false positives.

In certain embodiments, a dictionary may be trained 12 for a specific piano and acoustic environment. In fact, the training process may take less than 3 minutes in some embodiments (e.g., to record all notes of an 88 note piano). For example, in some embodiments, each note of a piano may each be played for about 1 second to train a dictionary. In some scenarios, such as piano practices, the acoustic environment of the piano may not substantially change, and a previously trained dictionary may be reused. Even for a piano performance in a new acoustic environment, taking insubstantial time (e.g., less than 5 minutes and in some embodiments about 3 minutes or less) to train the dictionary in addition to stage setup is acceptable for highly accurate transcription of the performance throughout the concert.

In some embodiments, the monaural, polyphonic piano audio recording, s(t), is recorded 14 under the conditions in which the plurality of waveforms are recorded 12. Embodiments of the disclosure may be more insensitive to reverb by recording 14 the audio to be transcribed in the same environment used for the dictionary training session, as is discussed in further detail below.

Figure 2:
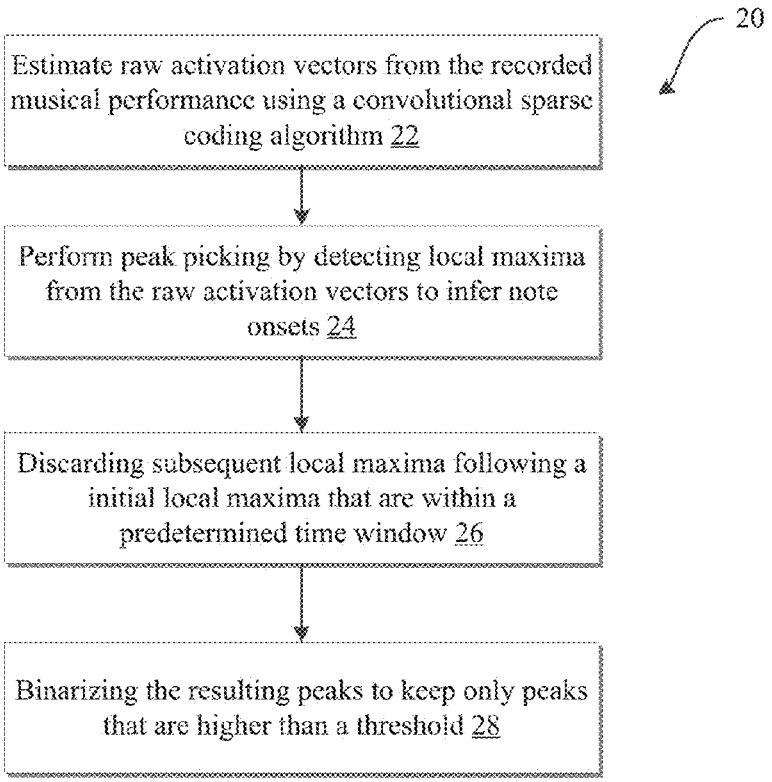
FIG. 2 illustrates an exemplary method of processing a piano performance recording according to some embodiments of the present disclosure.

Once the dictionary is trained 12 and the piano performance is recorded 14, the recorded performance may be processed 16 using the plurality of recorded waveforms 12. FIG. 2 illustrates an exemplary method 20 of processing the recorded audio signal of the performance. At step 22, raw activation vectors are estimated from the recorded musical performance using a convolutional sparse coding algorithm. At step 24, peak picking may be performed by detecting local maxima from the raw activation vectors to infer note onsets. At step 26, local maxima that are within a predetermined time window following an initial local maxima may be discarded. At step 28, the resulting peaks may be binarized to keep only peaks that are higher than a threshold.

The activations, $x_m(t)$, may be estimated 22 using an efficient convolutional sparse coding algorithm [51], [55].

The following provides background for convolutional sparse coding and an efficient algorithm for its application to automatic music transcription.

A. Convolutional Sparse Coding

Sparse coding, the inverse problem of sparse representation of a particular signal, has been approached in several ways. One of the most widely used is Basis Pursuit DeNoising (BPDN) [49]:

$$\underset{x}{\operatorname{argmin}} \frac{1}{2}\|Dx - s\|_2^2 + \lambda\|x\|_1, \tag{2}$$

where s is a signal to approximate, D is a dictionary matrix, x is the vector of activations of dictionary elements, and λ is a regularization parameter controlling the sparsity of x.

Convolutional Sparse Coding (CSC), also called shift-invariant sparse representation, extends the idea of sparse representation by using convolution instead of multiplication. Replacing the multiplication operator with convolution in Eq. (2) Convolutional Basis Pursuit DeNoising (CBPDN) [50] may be obtained:

$$\underset{\{x_m\}}{\operatorname{argmin}} \frac{1}{2}\left\|\sum_m d_m * x_m - s\right\|_2^2 + \lambda\sum_m \|x_m\|_1, \tag{3}$$

where $\{d_m\}$ is a set of dictionary elements, also called filters; $\{x_m\}$ is a set of activations, also called coefficient maps; and A controls the sparsity penalty on the coefficient maps $x_m$. Higher values of λ lead to sparser coefficient maps and a lower fidelity approximation to the signal, s.

CSC has been widely applied to various image processing problems, including classification, reconstruction, denoising and coding [51]. In the audio domain, s represents the audio waveform for analysis, $\{d_m\}$ represents a set of audio atoms, and $\{x_m\}$ represents their activations. Its applications to audio signals include music representations [38], [52] and audio classification [53]. However, its adoption has been limited by its computational complexity in favor of faster factorization techniques like NMF or PLCA.

CSC is computationally very expensive, due to the presence of the convolution operator. A straightforward implementation in the time-domain [54] has a complexity of $O(M^2N^2L)$, where M is the number of atoms in the dictionary, N is the size of the signal and L is the length of the atoms.

B. Efficient Convolutional Sparse Coding

While any fast convolutional sparse coding algorithm may be used, an efficient algorithm for CSC has recently been proposed [51], [55]. This algorithm is based on the Alternating Direction Method of Multipliers (ADMM) for convex optimization [56]. The algorithm iterates over updates on three sets of variables. One of these updates is trivial, and the other can be computed in closed form with low computational cost. The additional update comprises a computationally expensive optimization due to the presence of the convolution operator. A natural way to reduce the computational complexity of convolution is to use the Fast Fourier Transform (FFT), as proposed by Bristow et al. [57] with a computational complexity of $O(M^3N)$. The computational cost of this subproblem has been further reduced to O(MN) by exploiting the particular structure of the linear systems resulting from the transformation into the spectral domain [51], [55]. The overall complexity of the resulting is O(MN log N) since it is dominated by the cost of FFTs.

The activation vectors may be estimated 22 from the audio signal using an open source implementation [58] of the efficient convolutional sparse coding algorithm described above. In some embodiments, the sampling frequency of the audio mixture to be transcribed may be configured to match the sampling frequency used for the training stage (e.g., step 12). Accordingly, the audio mixtures may be downsampled as needed. For example, in some experimental implementations, the audio mixtures were downsampled to the sampling frequency of 11,025 Hz, mentioned above.

In some embodiments, 500 iterations may be used. Optionally, 200-400 iterations may be used in other embodiments as the algorithm generally converges after approximately 200 iterations. The result of this step is a set of raw activation vectors, which can be noisy due to the mismatch between the atoms in the dictionary and the instances in the audio mixture. Note that no non-negativity constraints may be applied in the formulation, so the activations can contain negative values. Negative activations can appear in order to correct mismatches in loudness and duration between the dictionary element and the actual note in the sound mixture. However, because the waveform of each note may be quite consistent across different instances, the strongest activations may be generally positive.

These activation vectors may be impulse trains, with each impulse indicating the onset of the corresponding note at a time. As mentioned above, however, in practice the estimated activations may contain some noise. After post-processing, the activation vectors may resemble impulse trains, and may recover the underlying ground-truth note-level transcription of the piece, an example of which is provided below.

Figure 3:
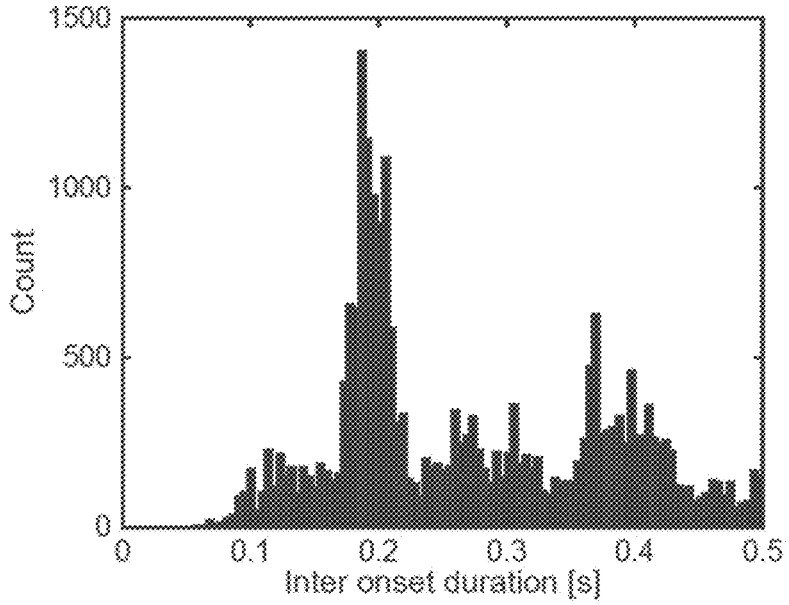
FIG. 3 illustrates a distribution of time intervals between two consecutive activations of the same note.

For post processing, peak picking may be performed 24 by detecting local maxima from the raw activation vectors to infer note onsets. However, because the activation vectors are noisy, multiple closely located peaks are often detected from the activation of one note. To deal with this problem, the earliest peak within a time window may be kept and the others may be discarded 26. This may enforce local sparsity of each activation vector. In some embodiments, a 50 ms time window was selected because it represents a realistic limit on how fast a performer can play the same note repeatedly. For example, FIG. 3 illustrates a distribution of time intervals between two consecutive activations of the same note in the ENSTDkCl collection of the MAPS dataset [23]. The collection contains 76,364 individual note activations, 74,740 of which are of notes repeated at least twice in the same piece. As can be seen, at least 50 ms separates consecutive activations of the same note in this collection.

Thereafter, the resulting peaks may be binarized 28 to keep only peaks that are within a predetermined threshold of the highest peak in the entire activation matrix. For example, in some embodiments, only the peaks that are higher than 10% of the highest peak may be kept. This step 28 may reduce ghost notes (i.e., false positives) and may increase the precision of the transcription. Optionally, the threshold may be between 1%-15% of the highest peak.

After processing the recorded musical performance 16 to determine the activation vectors and the note onsets, the inferred note onsets and activation vectors 18 may be outputted to a user (e.g., printed, displayed, electronically copied/transmitted, or the like). For example, the activation vectors and note onsets may be outputted in the form of a music notation or a piano roll associated with the musical performance.

FIGS. 4-7 illustrate the exemplary methods 10, 20 of FIGS. 1-2. FIG. 4 illustrates a piano roll associated with Bach's Minuet in G major, BWV Anh 114, from the Notebook for Anna Magdalena Bach. The piano roll may include overlapping harmonics and/or multiple simultaneous notes. The exemplary piano roll is the underlying ground-truth note-level piano roll that is recoverable utilizing methods and systems disclosed herein.

FIG. 5 illustrates an audio recording or waveform associated with the piano roll of FIG. 4. FIG. 6 illustrates raw activation vectors estimated from the efficient convolutional sparse coding algorithm described above using the waveform of FIG. 5 as input, s(t), and dictionary elements of the notes of the piano, $d_m(t)$. As illustrated, a plurality of raw activation vectors may be determined, each associated with a key of the piano. As can be seen, the activation vectors may include some noise. However, after post-processing (e.g., steps 24-28), the activation vectors resemble impulse trains as illustrated in FIG. 7.

Figure 8:
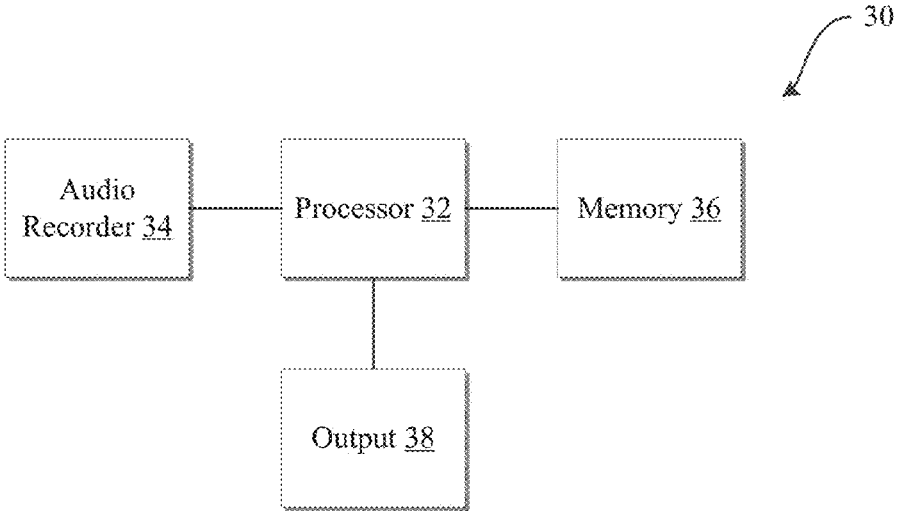
FIG. 8 illustrates an exemplary system for transcribing a piano performance according to some embodiments of the present disclosure.

FIG. 8 illustrates an exemplary system 30 for transcribing a piano performance according to embodiments of the methods described above. System 30 may include a processor 32 operably coupled with an audio recorder 34 and a memory 36. The processor 32 and audio recorder 34 may be configured to record the notes of the piano for the dictionary training and to record the piano performance. The audio recordings may be stored in memory 36. The processor may also be configured to process the stored audio recordings to determine the activation vectors and the note onsets in a manner described above. Thereafter, the note onsets and activation vectors may be outputted to output 38. Output 38 may be a printer, display, electronic transmission, or the like.

In certain embodiments, methods and systems may be based on the assumption that the waveform of a note of the piano is consistent when the note is played at different times. This assumption is valid, thanks to the mechanism of piano note production [59]. Each piano key is associated with a hammer, one to three strings, and a damper that touches the string(s) by default. When the key is pressed, the hammer strikes the string(s) while the damper is raised from the string(s). The string(s) vibrate freely to produce the note waveform until the damper returns to the string(s), when the key is released. The frequency of the note is determined by the string(s); it is stable and cannot be changed by the performer (e.g., vibrato is impossible). The loudness of the note is determined by the velocity of the hammer strike, which is affected by how hard the key is pressed. Modern pianos generally have three foot pedals: sustain pedal, sostenuto pedal, and soft pedal; some models omit the sostenuto pedal. The sustain pedal is commonly used. When it is pressed, all dampers of all notes are released from all strings, no matter whether a key is pressed or released. Therefore, its usage only affects the offset of a note, if the slight sympathetic vibration of strings across notes is ignored. The sostenuto pedal behaves similarly, but only releases dampers that are already raised without affecting other dampers. The soft pedal changes the way that the hammer strikes the string(s), hence it affects the timbre or the loudness, but its use is rare compared to the use of the other pedals.

Figure 9:
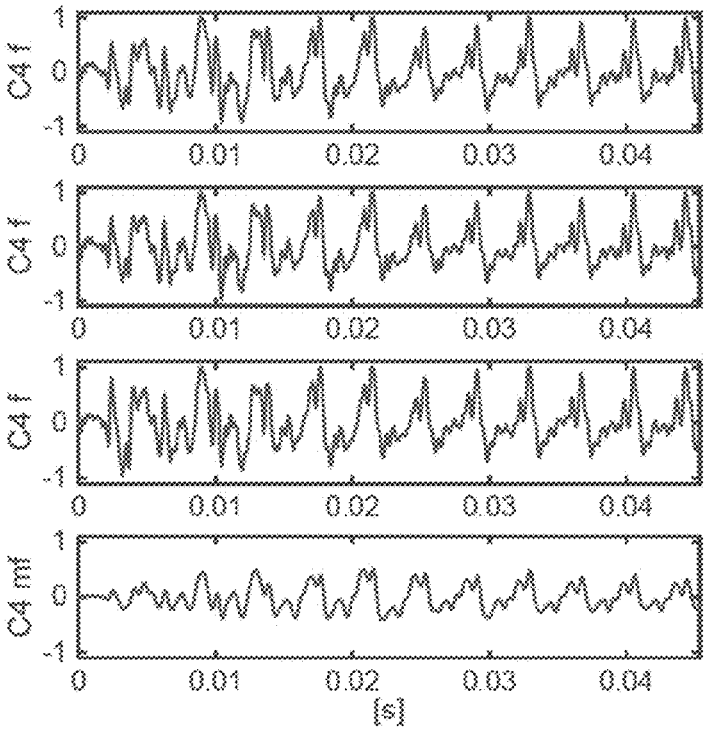
FIG. 9 illustrates waveforms of four different instances of note C4 played manually on an acoustic piano.

FIG. 9 shows the waveforms of four different instances of the C4 note played on an acoustic piano at two dynamic levels—three instances of the C4 note were played at forte (f) and one at mezzo forte (mf). Their waveforms are very similar, after appropriate scaling. The three f notes are very similar, even in the transient region of the initial 20 ms. The waveform of the mf note is slightly different, but still resembles the other waveforms after applying a global scaling factor.

Plumbley et al. [38] suggested a model similar to the one proposed here, but with two major differences. First of all they attempted an unsupervised approach by learning the dictionary atoms from the audio mixture, by using an oracle estimation of the number of individual notes present in the piece; the dictionary atoms were manually labeled and ordered to represent the individual notes. Second, they used very short dictionary elements (125 ms), which was found not to be sufficient to achieve good accuracy in transcription. Moreover, their experimental section was limited to a single piano piece and no evaluation of the transcription was performed.

EXPERIMENTS

Experiments were conducted to answer two questions: (1) How sensitive is the proposed method to key parameters such as the sparsity parameter λ, and the length and loudness of the dictionary elements; and (2) how does the proposed method compare with state-of-the-art piano transcription methods in different settings such as anechoic, noisy, and reverberant environments?

In order to validate the method in a realistic scenario embodiments described herein were tested on pieces performed on a Disklavier, which is an acoustic piano with mechanical actuators that can be controlled via MIDI input. The Disklavier enables a realistic performance on an acoustic piano along with its ground truth note-level transcription. The ENSTDkCl collection of the MAPS dataset [23] was used. This collection contains 30 pieces of different styles and genres generated from high quality MIDI files that were manually edited to achieve realistic and expressive performances. The audio was recorded in a close microphone setting to minimize the effects of reverb.

F-measure was used to evaluate the note-level transcription [4]. It is defined as the harmonic mean of precision and recall, where precision is defined as the percentage of correctly transcribed notes among all transcribed notes, and recall is defined as the percentage of correctly transcribed notes among all ground-truth notes. A note is considered correctly transcribed if its estimated discretized pitch is the same as a reference note in the ground-truth and the estimated onset is within a given tolerance value (e.g., ±50 ms) of the reference note. Offsets were not considered in deciding the correctness.

A. Parameter Dependency

Figure 10:
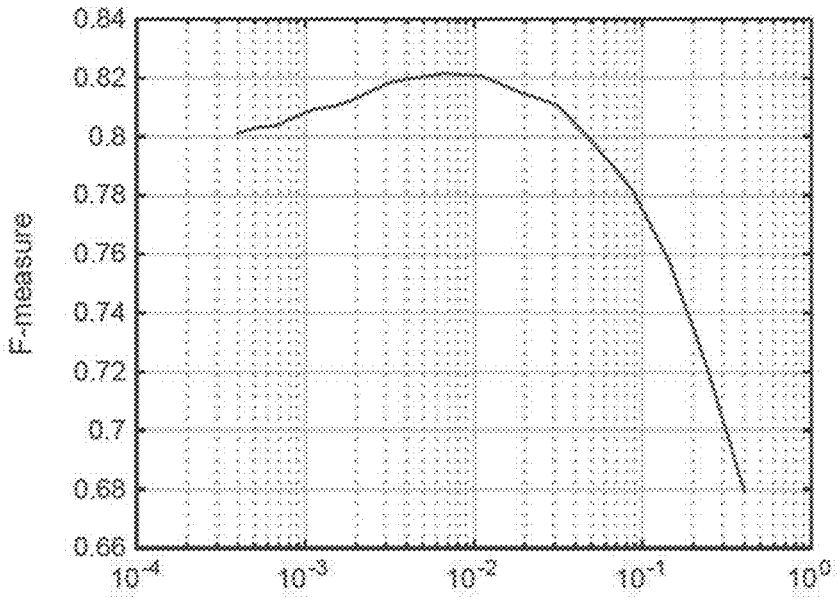
FIG. 10 illustrates average F-measure on the 30 pieces in the ENSTDkCl collection of the MAPS dataset for different values of $\lambda$.

To investigate the dependency of the performance on the parameter λ, a grid search was performed with values of λ logarithmically spaced from 0.4 to 0.0004 on the original ENSTDkCl collection in the MAPS dataset [23]. The results are shown in FIG. 10. The average F-measure on the 30 pieces in the ENSTDkCl collection of the MAPS data set versus the length is shown in FIG. 10 for different values of λ. As can be observed from FIG. 10, the method is not very sensitive to the value of λ. For a wide range of values, from 0.0004 to about 0.03, the average F-measure is always above 80%.

Figure 11:
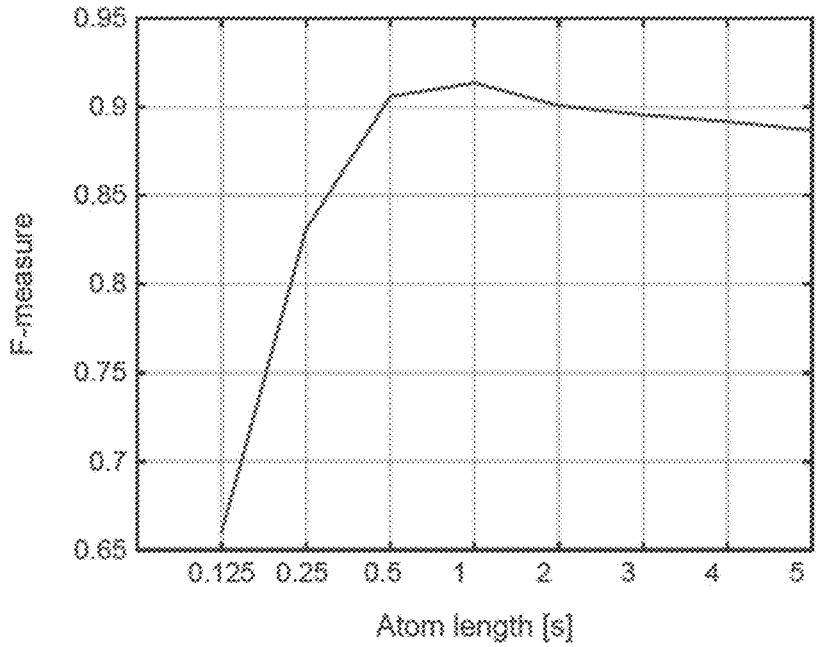
FIG. 11 illustrates average F-measure on the 30 pieces in the ENSTDkCl collection of the MAPS data set versus dictionary atom length.

The performance of the method and system with respect to the length of the dictionary elements was also investigated. FIG. 11 illustrates average F-measure on the 30 pieces in the ENSTDkCl collection of the MAPS data set versus dictionary atom length. The highest F-measure may be achieved when the dictionary elements are 1 second long. The MAPS dataset contains pieces of very different styles, from slow pieces with long chords, to virtuoso pieces with fast runs of short notes. It was discovered that longer dictionary elements generally give better results for all the pieces. The highest F-measure was reached with a dictionary element length of 1 s for the vast majority of the pieces. Accordingly, embodiments of the present disclosure may utilize atom lengths of 0.25-5 s, and more preferably lengths of 0.5-2 s (e.g., 1 s).

Figure 12:
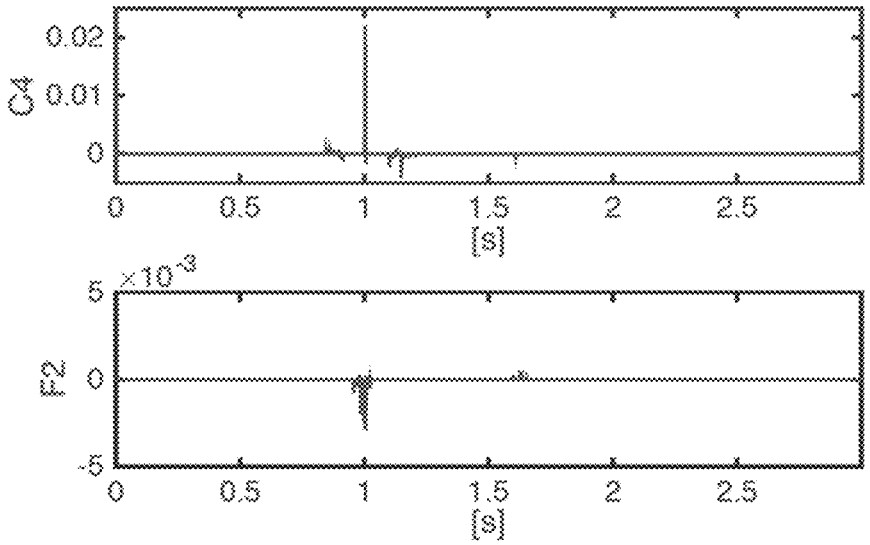
FIG. 12 illustrates raw activations of the two most active note templates when transcribing a piano C4 note with 88 forte note templates.
Figure 13:
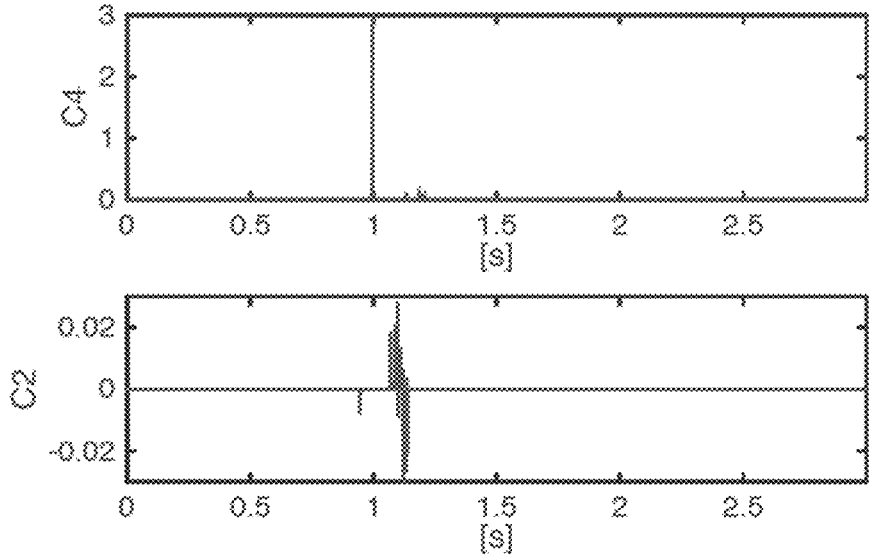
FIG. 13 illustrates raw activations of the two most active note templates when transcribing forte C4 note with 88 piano note templates.

Finally, the effect of the dynamic level of the dictionary atoms was investigated. In general, the proposed method was found to be very robust to differences in dynamic levels, but better results may be obtained when louder dynamics were used during the training. A possible explanation can be seen in FIGS. 12 and 13. For FIG. 12 a signal was transcribed consisting of a single C4 note played piano with a dictionary of forte notes. FIG. 12 illustrates raw activations of the two most active note templates when transcribing the piano C4 note with 88 forte note templates. The second most active note shows strong negative activations, which do not influence the transcription, as only positive peaks were considered in this particular implementation. The negative activations might be due to the extra partials contained in the forte dictionary element but not present in the piano note. CSC may try to achieve a better reconstruction by subtracting some frequency content. On the other side, in FIG. 13 the opposite scenario was tested where a single C4 note played forte with a dictionary of piano notes. FIG. 13 illustrates raw activations of the two most active note templates when transcribing forte C4 note with 88 piano note templates. The second most active note shows both positive and negative activations. Positive activations might potentially lead to false positives. In this case, the forte note contains some spectral content not present in the piano template, so CSC may improve the signal reconstruction by adding other note templates.

B. Comparison to the State of the Art

Embodiments of the method described herein were compared with a state-of-the-art AMT method proposed by Benetos and Dixon [29], which was submitted for evaluation to MIREX 2013 as BW3. The method will be referred to as BW3-MIREX13. This method is based on probabilistic latent component analysis of a log-spectrogram energy and uses pre-extracted note templates from isolated notes. The templates are also pre-shifted along the log-frequency in order to support vibrato and frequency deviations, which are not an issue for piano music. The method is frame-based and does not model the temporal evolution of notes. To make a fair comparison, dictionary templates of both BW3-MIREX13 and the proposed method were learned on individual notes of the piano that was used in the test pieces. The implementation provided by the author was used along with the provided parameters, with the only exception of the hop size, which was reduced to 5 ms to test the onset detection accuracy.

1) Anechoic Settings:

In addition to the test with the original MAPS dataset, the proposed method was also tested on the same pieces re-synthesized with a virtual piano, in order to set a baseline of the performance in an ideal scenario, i.e., absence of noise and reverb. For the baseline experiment, all the pieces have been re-rendered from the MIDI files using a digital audio workstation (Logic Pro 9) with a sampled virtual piano plug-in (Steinway Concert Grand Piano from the Garritan Personal Orchestra); no reverb was used at any stage. For this set of experiments multiple onset tolerance values were tested to show the highest onset precision achieved by the proposed method.

Figure 14:
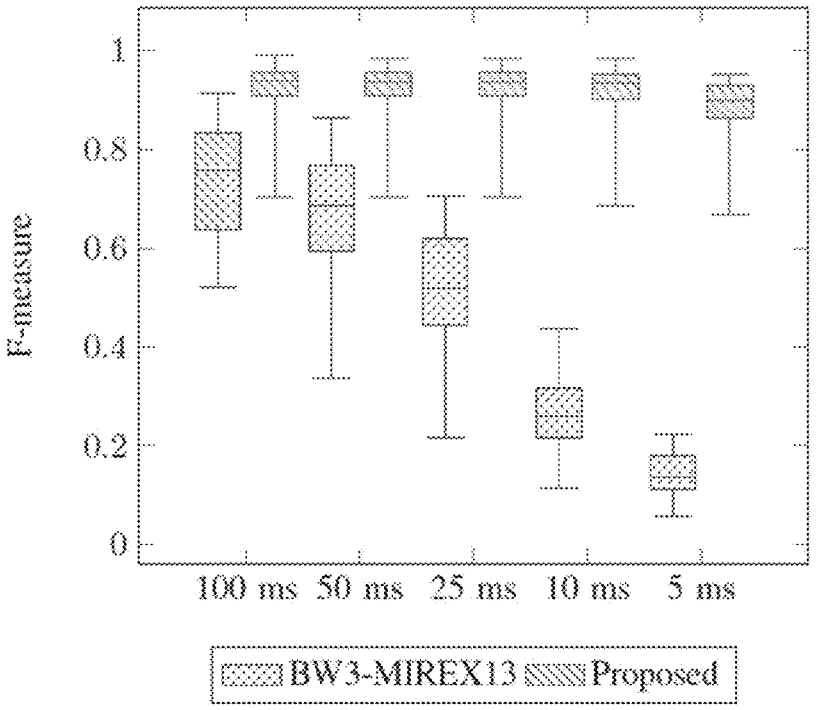
FIG. 14 illustrates F-measure for the synthetic re-rendering of the 30 pieces in the ENSTDkCl collection of the MAPS dataset.
Figure 15:
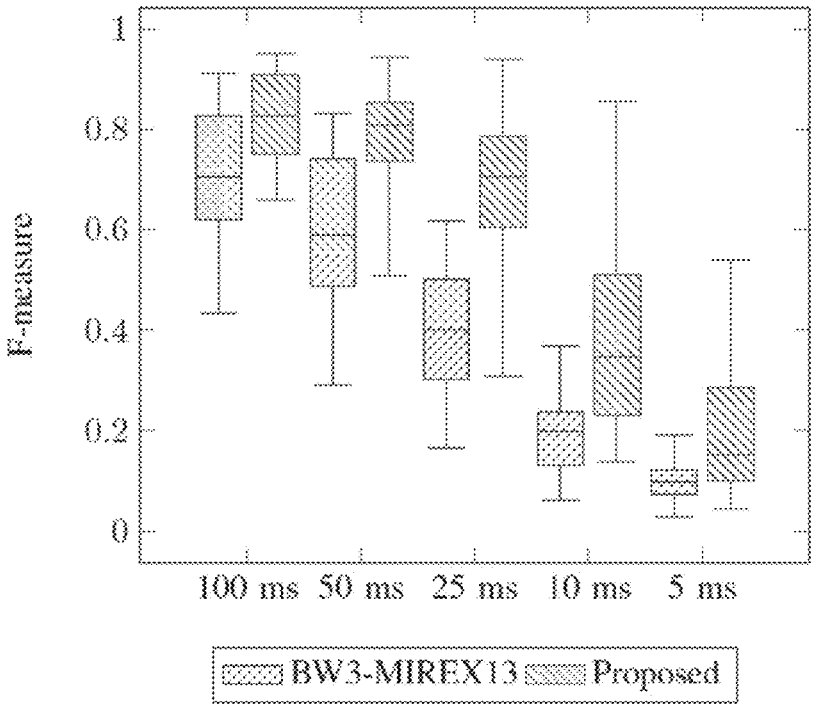
FIG. 15 illustrates F-measure for the 30 pieces in the ENSTDkCl collection of the MAPS data set.

The results are shown in FIG. 14 and FIG. 15. FIG. 14 illustrates F-measure for the synthetic re-rendering of the 30 pieces in the ENSTDkCl collection of the MAPS dataset. FIG. 15 illustrates F-measure for the 30 pieces in the ENSTDkCl collection of the MAPS data set. Each box contains 30 data points. In both experiments, the proposed method outperforms BW3-MIREX13 by at least 20% in median F-measure for onset tolerance of 50 ms and 25 ms (50 ms is the standard onset tolerance used in MIREX [4]). In the experiment with the synthetic piano, shown in FIG. 14, the proposed method exhibits consistent accuracy of over 90% regardless of the onset tolerance, while the performance of BW3-MIREX13 degrades quickly as the tolerance decreases under 50 ms. The proposed method maintains a median F-measure of 90% even with an onset tolerance of 5 ms. In the experiment on acoustic piano, both the proposed method and BW3-MIREX13 show a degradation of the performances with small tolerance values of 10 ms and 5 ms.

Figures 16, 17:
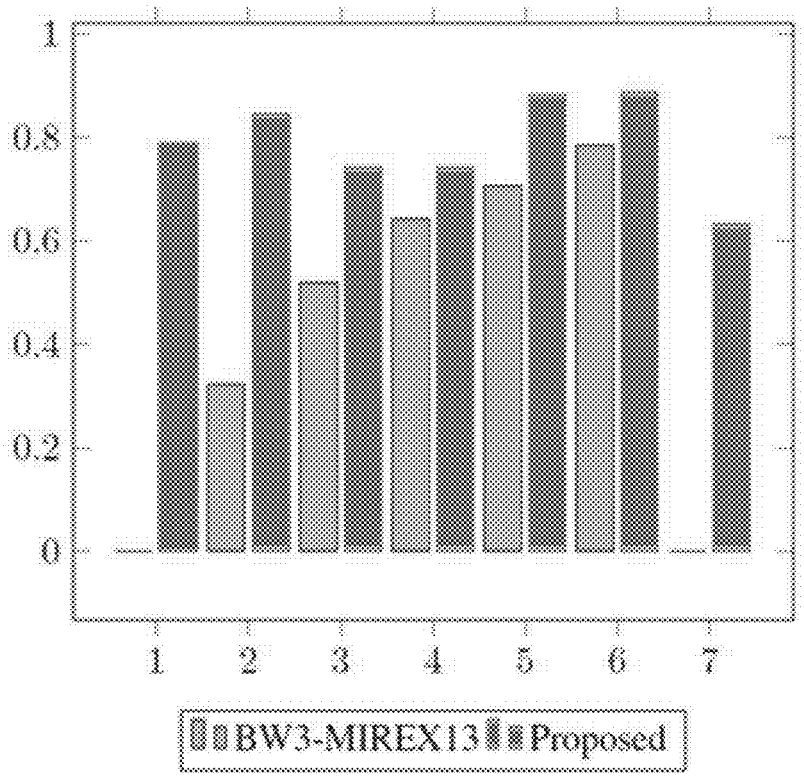
FIG. 16 illustrates average F-measure per octave.
FIG. 17 illustrates a table shown notes in the ground truth per octave.

FIG. 16 compares the average F-measure achieved by the two methods along the different octaves of a piano keyboard (the first octave is from A0 to B1, the second one from C2 to B2, and so on) with an onset tolerance of 50 ms. The distribution of the notes in the ground truth per octave is shown in Table I of FIG. 17. The figure clearly shows that the results of BW3-MIREX13 are dependent on the fundamental frequencies of the notes; the results are very poor for the first two octaves, and increase monotonically for higher octaves, except for the highest octave, which is not statistically significant (see Table I). The proposed method shows a more balanced distribution. This suggests the advantage of the time-domain approach in avoiding the time-frequency resolution trade-off. In embodiments described herein, each dictionary atom may contain multiple partials spanning a wide spectral range, and the relative phase and magnitude of the partials for a given note may have low variability across instances of that note. This, together with the sparsity penalty, which limits the model complexity, allows for good performance without implicit violation of fundamental time-frequency resolution limitations.

Figure 19:
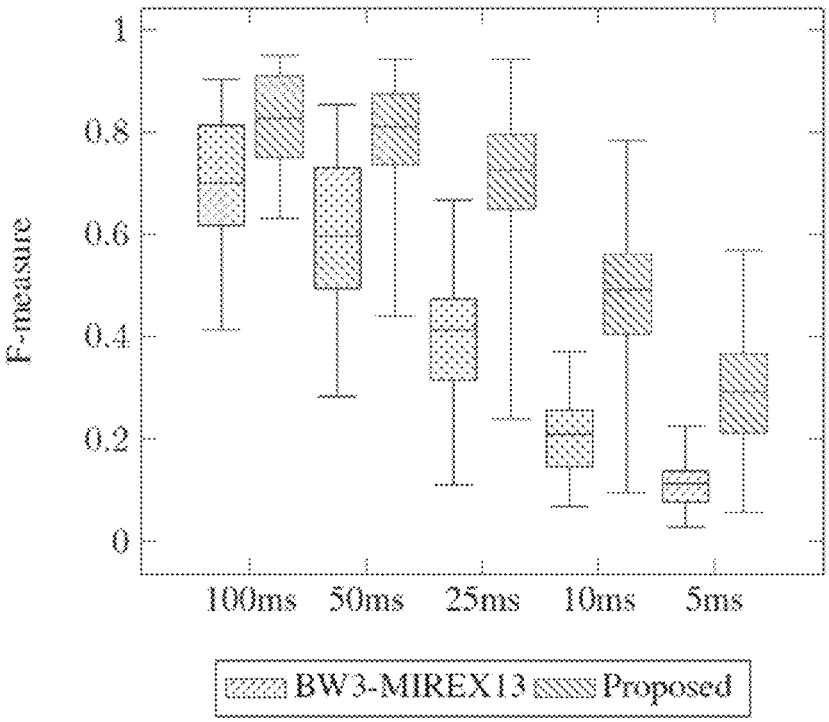
FIG. 19 illustrates F-measure for the 30 pieces in the ENSTDkCl collection of MAPS with corrected alignment.

The degradation of performance on the acoustic piano with small tolerance values drove further inspection of the algorithm and the ground truth. It was noticed that the audio and the ground truth transcription in the MAPS database are in fact not consistently lined up, i.e., different pieces show a different delay between the activation of the note in the MIDI file and the corresponding onset in the audio file. FIGS. 18A-18B illustrates two pieces from the ENSTDkCl collection in MAPS showing different alignments between audio and ground truth MIDI notes (red bars). The audio files were downmixed to mono for visualization. FIG. 18B shows a good alignment between the audio and MIDI onsets, but in FIG. 18A, the MIDI onsets occur 15 ms earlier than audio onsets. This inconsistency may be responsible for the poor results with small tolerance values. To test this hypothesis the ground truth was re-aligned with the audio by picking the mode of the onset differences for the correctly identified notes by the proposed method per piece. The same approach was applied to BW3-MIREX13 and then recalculated the F-measure with the aligned ground truths. FIG. 19 illustrates F-measure for the 30 pieces in the ENSTDkCl collection of MAPS with corrected alignment. With the aligned ground truth, the proposed method increases the median F-measure by about 15% at 10 ms and 5 ms. This suggests that there are indeed some alignment problems between the audio and ground-truth MIDI transcription. For the following experiments, however, the original non-corrected ground truth was used for evaluation. As noted previously, the time-domain approach alone may not explain the increased accuracy, especially for low-pitched notes, as the $l_2$ norm in Eq. 3 is actually less sensitive to time differences at low frequencies; but since each atom contains a wide range of frequencies, even low-pitched notes contain partials at relatively high frequencies, for which the $l_2$ norm can provide a better time localization.

Figure 20:
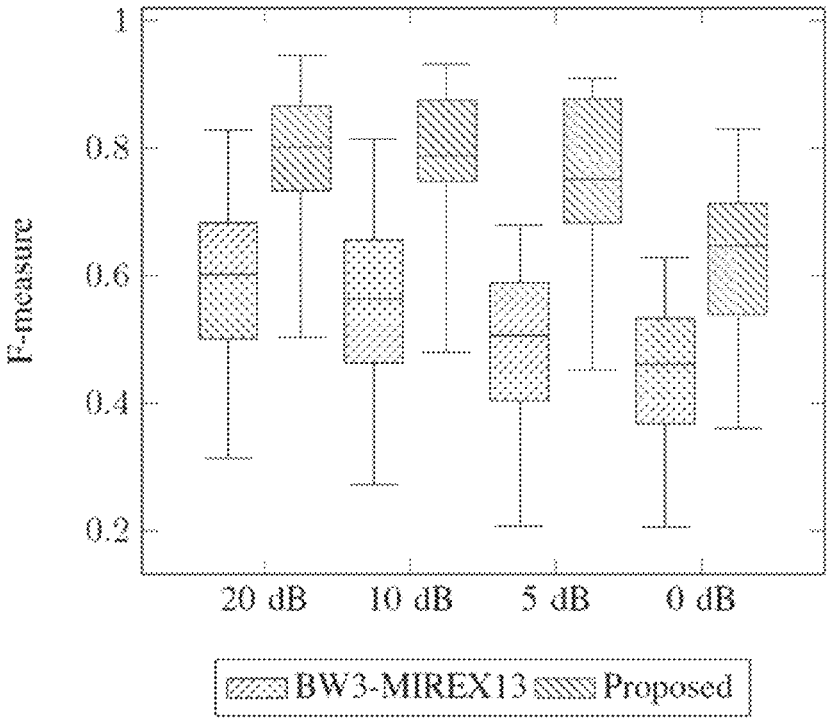
FIG. 20 illustrates F-measure for the 30 pieces in the ENSTDkCl collection of MAPS with white noise at different SNR levels.
Figure 21:
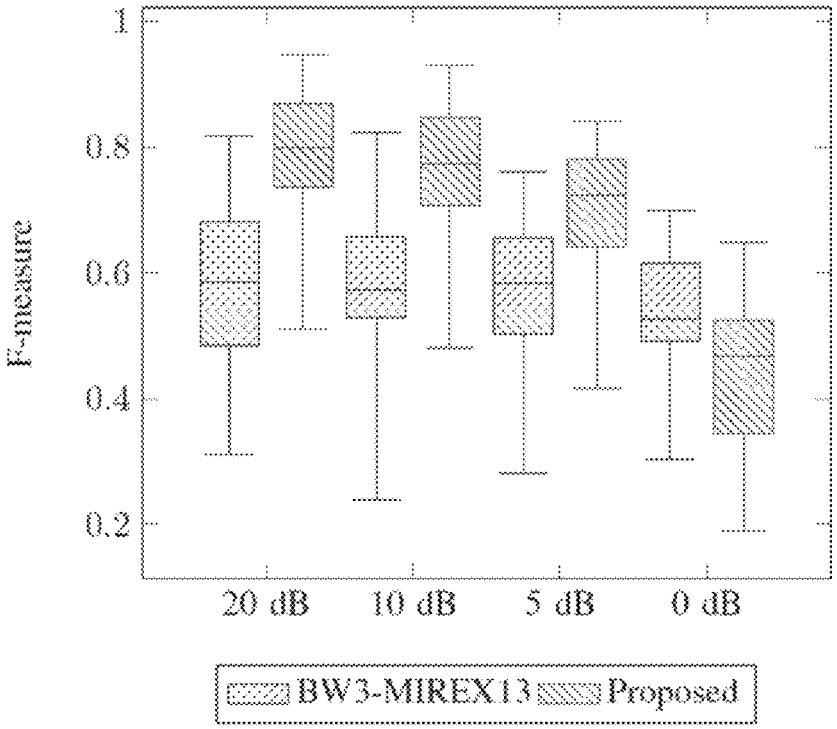
FIG. 21 illustrates F-measure for the 30 pieces in the ENSTDkCl collection of MAPS with pink noise at different SNR levels.

2) Robustness to Noise:

In this section, the robustness of the proposed method to noise was investigated and the results were compared with BW3-MIREX13. Both white and pink noise were tested on the original ENSTDkCl collection of MAPS. White and pink noises can represent typical background noises (e.g., air conditioning) in houses or practice rooms. The results are shown in FIG. 20 and FIG. 21. FIG. 20 illustrates F-measure for the 30 pieces in the ENSTDkCl collection of MAPS with white noise at different SNR levels. FIG. 21 illustrates F-measure for the 30 pieces in the ENSTDkCl collection of MAPS with pink noise at different SNR levels. As can be seen from the plots, the proposed method shows great robustness to white noise, even at very low SNRs, always having a definite advantage over BW3-MIREX13. The proposed method outperforms BW3-MIREX13 by about 20% in median F-measure, regardless of the level of noise. The proposed method is also very tolerant to pink noise and outperforms BW3-MIREX13 with low and medium level of noise, up to an SNR of 5 dB.

Figure 22:
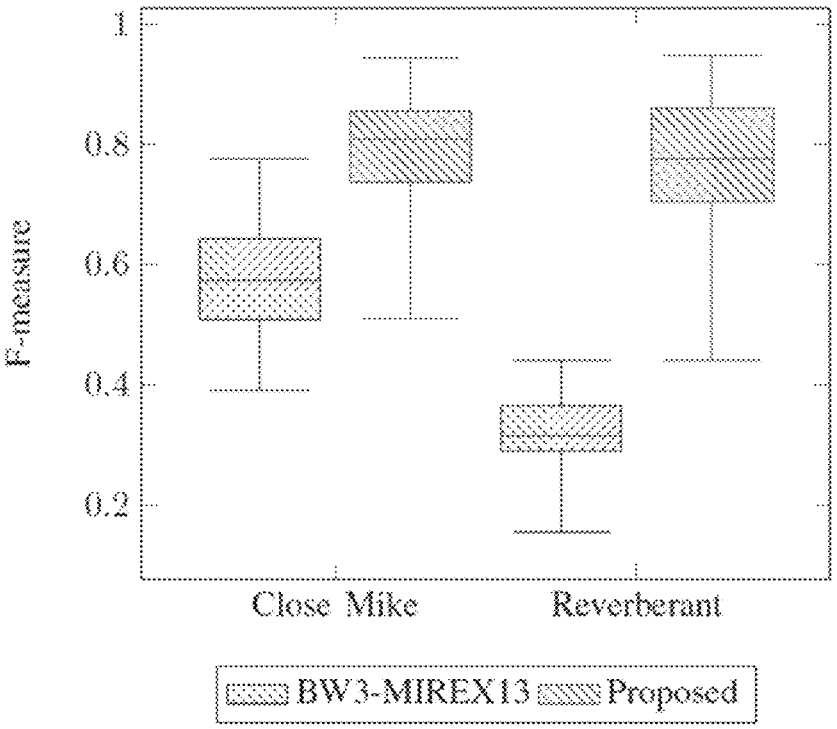
FIG. 22 illustrates F-measure for the 30 pieces in the ENSTDkCl collection of MAPS with reverb.

3) Robustness to Reverberation:

In the third set of experiments, the performance of the proposed method was tested in the presence of reverberation. Reverberation exists in almost all real-world performing and recording environments, however, few systems have been designed and evaluated in reverberant environments in the literature. Reverberation is not even mentioned in recent surveys [1], [61]. A real impulse response of an untreated recording space was used with a T60 of about 2.5 s, and convolved it with the dictionary elements and the audio files. FIG. 22 illustrates the F-measure results for the 30 pieces in the ENSTDkCl collection of MAPS with reverb. As can be seen, the median F-measure is reduced by about 3% for the proposed method in presence of reverb, showing a high robustness to reverb. The performance of BW3-MIREX13, however, degrades significantly, even though it was trained on the same reverberant piano notes. This further shows the advantage of the proposed method in real acoustic environments.

Accordingly, some embodiments of the present disclosure provide an automatic music transcription algorithm based on convolutional sparse coding in the time-domain. The proposed algorithm consistently outperforms a state-of-the-art algorithm trained in the same scenario in all synthetic, anechoic, noisy, and reverberant settings, except for the case of pink noise at SNR=0 dB. The proposed method achieves high transcription accuracy and time precision in a variety of different scenarios, and is highly robust to moderate amounts of noise. It may also highly insensitive to reverb when the session is performed in the same environment used for recording the audio to be transcribed.

In further embodiments, a dictionary may be obtained or provided that contains notes of different lengths and different dynamics which may be used to estimate note offsets or dynamics. In such embodiments, group sparsity constraints may be introduced in order to avoid the concurrent activations of multiple templates for the same pitch.

While the methods and systems are described above for transcribing piano performances, other embodiments may be utilized on other percussive and plucked pitched instruments such as harpsichord, marimba, classical guitar, bells and carillon, given the consistent nature of their notes and the model's ability to capture temporal evolutions.

One or more computing devices may be adapted to provide desired functionality by accessing software instructions rendered in a computer-readable form. When software is used, any suitable programming, scripting, or other type of language or combinations of languages may be used to implement the teachings contained herein. However, software need not be used exclusively, or at all. For example, some embodiments of the methods and systems set forth herein may also be implemented by hard-wired logic or other circuitry, including but not limited to application-specific circuits. Combinations of computer-executed software and hard-wired logic or other circuitry may be suitable as well.

Embodiments of the methods disclosed herein may be executed by one or more suitable computing devices. Such system(s) may comprise one or more computing devices adapted to perform one or more embodiments of the methods disclosed herein. As noted above, such devices may access one or more computer-readable media that embody computer-readable instructions which, when executed by at least one computer, cause the at least one computer to implement one or more embodiments of the methods of the present subject matter. Additionally or alternatively, the computing device(s) may comprise circuitry that renders the device(s) operative to implement one or more of the methods of the present subject matter.

Any suitable computer-readable medium or media may be used to implement or practice the presently-disclosed subject matter, including but not limited to, diskettes, drives, and other magnetic-based storage media, optical storage media, including disks (e.g., CD-ROMS, DVD-ROMS, variants thereof, etc.), flash, RAM, ROM, and other memory devices, and the like.

The subject matter of embodiments of the present invention is described here with specificity, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

List of References, each of which is incorporated herein in its entirety:

[1] E. Benetos, S. Dixon, D. Giannoulis, H. Kirchhoff, and A. Klapuri, "Automatic music transcription: challenges and future directions," *Journal of Intelligent Information Systems*, vol. 41, no. 3, pp. 407-434, 2013.

[2] J. A. Moorer, "On the transcription of musical sound by computer," *Computer Music Journal*, pp. 32-38, 1977.

[3] M. Piszczalski and B. A. Galler, "Automatic music transcription," *Computer Music Journal*, vol. 1, no. 4, pp. 24-31, 1977.

[4] M. Bay, A. F. Ehmann, and J. S. Downie, "Evaluation of multiple-f0 estimation and tracking systems." in *Proc. ISMIR,* 2009, pp. 315-320.

[5] P. R. Cook, *Music, cognition, and computerized sound*. Cambridge, Mass.: Mit Press, 1999.

[6] J. P. Bello, L. Daudet, S. Abdallah, C. Duxbury, M. Davies, and M. B. Sandler, "A tutorial on onset detection in music signals," *IEEE Transactions on Speech and Audio Processing*, vol. 13, no. 5, pp. 1035-1047, 2005.

[7] A. De Cheveigné and H. Kawahara, "YIN, a fundamental frequency estimator for speech and music," *The Journal of the Acoustical Society of America*, vol. 111, no. 4, pp. 1917-1930, 2002.

[8] D. Gabor, "Theory of communication. part 1: The analysis of information," *Journal of the Institution of Electrical Engineers Part III: Radio and Communication Engineering*, vol. 93, no. 26, pp. 429-441, 1946.

[9] A. Cogliati, Z. Duan, and B. Wohlberg, "Piano music transcription with fast convolutional sparse coding," in *Machine Learning for Signal Processing* (*MLSP*), 2015 *IEEE 25th International Workshop on*, September 2015, pp. 1-6.

[10] C. Raphael, "Automatic transcription of piano music." in *Proc. ISMIR,* 2002.

[11] A. P. Klapuri, "Multiple fundamental frequency estimation based on harmonicity and spectral smoothness," *IEEE Transactions on Speech and Audio Processing*, vol. 11, no. 6, pp. 804-816, 2003.

[12] C. Yeh, A. Ro"bel, and X. Rodet, "Multiple fundamental frequency estimation of polyphonic music signals," in *Proc. of IEEE International Conference on Acoustics, Speech, and Signal Processing* (*ICASSP*), vol. 3, 2005, pp. iii-225.

[13] K. Dressler, "Multiple fundamental frequency extraction for mirex 2012*," Eighth Music Information Retrieval Evaluation eXchange* (*MIREX*), 2012.

[14] G. Poliner and D. Ellis, "A discriminative model for polyphonic piano transcription," *EURASIP Journal on Advances in Signal Processing*, no. 8, pp. 154-162, January 2007.

[15] A. Pertusa and J. M. Mesta, "Multiple fundamental frequency estimation using Gaussian smoothness," in *IEEE International Conference on Audio, Speech, and Signal Processing*, April 2008, pp. 105-108.

[16] S. Saito, H. Kameoka, K. Takahashi, T. Nishimoto, and S. Sagayama, "Specmurt analysis of polyphonic music signals," *IEEE Transactions on Audio, Speech, and Language Processing*, vol. 16, no. 3, pp. 639-650, March 2008.

[17] J. Nam, J. Ngiam, H. Lee, and M. Slaney, "A classification-based polyphonic piano transcription approach using learned feature represen-tations." in *Proc. ISMIR,* 2011, pp. 175-180.

[18] S. Böck and M. Schedl, "Polyphonic piano note transcription with recurrent neural networks," in *IEEE International Conference on Audio, Speech, and Signal Processing*, March 2012, pp. 121-124.

[19] N. Boulanger-Lewandowski, Y. Bengio, and P. Vincent, "Modeling temporal dependencies in high-dimensional sequences: Application to polyphonic music generation and transcription," in *29th International Conference on Machine Learning*, Edinburgh, Scotland, U K, 2012.

[20] S. Sigtia, E. Benetos, N. Boulanger-Lewandowski, T. Weyde, A. S. d'Avila Garcez, and S. Dixon, "A hybrid recurrent neural network for music transcription," in *IEEE International Conference on Acoustics, Speech, and Signal Processing*, Brisbane, Australia, April 2015, pp. 2061-2065.

[21] M. Goto, "A real-time music-scene-description system: Predominant-f0 estimation for detecting melody and bass lines in real-world audio signals," *Speech Communication*, vol. 43, no. 4, pp. 311-329, 2004.

[22] Z. Duan, B. Pardo, and C. Zhang, "Multiple fundamental frequency estimation by modeling spectral peaks and non-peak regions," *Audio, Speech, and Language Processing, IEEE Transactions on*, vol. 18, no. 8, pp. 2121-2133, 2010.

[23] V. Emiya, R. Badeau, and B. David, "Multipitch estimation of piano sounds using a new probabilistic spectral smoothness principle," *IEEE Transactions on Audio, Speech, and Language Processing*, vol. 18, no. 6, pp. 1643-1654, 2010.

[24] P. Peeling and S. Godsill, "Multiple pitch estimation using non-homogeneous poisson processes," *IEEE Journal of Selected Topics in Signal Processing*, vol. 5, no. 6, pp. 1133-1143, October 2011.

[25] D. D. Lee and H. S. Seung, "Learning the parts of objects by non-negative matrix factorization," *Nature*, vol. 401, no. 6755, pp. 788-91, 1999.

[26] P. Smaragdis, B. Raj, and M. Shashanka, "A probabilistic latent variable model for acoustic modeling," *In Workshop on Advances in Models for Acoustic Processing at NIPS,* 2006.

[27] P. Smaragdis and J. C. Brown, "Non-negative matrix factorization for polyphonic music transcription," in *Proc. IEEE Workshop on Applica-tions of Signal Processing to Audio and Acoustics* (*WASPAA*), 2003.

[28] G. C. Grindlay and D. P. W. Ellis, "Transcribing multi-instrument polyphonic music with hierarchical eigeninstruments," *IEEE Journal of Selected Topics in Signal Processing*, vol. 5, no. 6, pp. 1159-1169, 2011.

[29] E. Benetos and S. Dixon, "A shift-invariant latent variable model for automatic music transcription," *Computer Music Journal*, vol. 36, no. 4, pp. 81-94, 2012.

[30] S. A. Abdallah and M. D. Plumbley, "Polyphonic music transcription by non-negative sparse coding of power spectra," in *5th International Conference on Music Information Retrieval* (*ISMIR*), 2004, pp. 318-325.

[31] K. O'Hanlon, H. Nagano, and M. D. Plumbley, "Structured sparsity for automatic music transcription," in *Proc. of IEEE International Conference on Acoustics, Speech, and Signal Processing* (*ICASSP*), 2012, pp. 441-444.

[32] K. O'Hanlon and M. D. Plumbley, "Polyphonic piano transcription using non-negative matrix factorisation with group sparsity," in *Proc. of IEEE International Conference on Acoustics, Speech, and Signal Processing* (*ICASSP*), 2014, pp. 3112-3116.

[33] R. Meddis and M. J. Hewitt, "Virtual pitch and phase sensitivity of a computer model of the auditory periphery. i: pitch identification," *Journal of the Acoustical Society of America*, vol. 89, pp. 2866-2882, 1991.

[34] T. Tolonen and M. Karjalainen, "A computationally efficient multipitch analysis model," *IEEE Transactions on Speech and Audio Processing*, vol. 8, no. 6, pp. 708-716, November 2000.

[35] P. J. Walmsley, S. J. Godsill, and P. J. Rayner, "Polyphonic pitch tracking using joint bayesian estimation of multiple frame parameters," in *Applications of Signal Processing to Audio and Acoustics,* 1999 *IEEE Workshop on*. IEEE, 1999, pp. 119-122.

[36] A. T. Cemgil, H. J. Kappen, and D. Barber, "A generative model for music transcription," *IEEE Transactions on Audio, Speech, and Language Processing*, vol. 14, no. 2, pp. 679-694, March 2006.

[37] M. Davy, S. Godsill, and J. Idier, "Bayesian analysis of polyphonic western tonal music," *The Journal of the Acoustical Society of America*, vol. 119, no. 4, pp. 2498-2517, 2006.

[38] M. D. Plumbley, S. A. Abdallah, T. Blumensath, and M. E. Davies, "Sparse representations of polyphonic music," *Signal Processing*, vol. 86, no. 3, pp. 417-431, 2006.

[39] J. P. Bello, L. Daudet, and M. B. Sandler, "Automatic piano transcription using frequency and time-domain information," *IEEE Transactions on Audio, Speech, and Language Processing*, vol. 14, no. 6, pp. 2242-2251, 2006.

[40] L. Su and Y.-H. Yang, "Combining spectral and temporal representations for multipitch estimation of polyphonic music," *IEEE/ACM Transactions on Audio, Speech and Language Processing*, vol. 23, no. 10, pp. 1600-1612, October 2015.

[41] M. Ryynänen and A. Klapuri, "Automatic transcription of melody, bass line, and chords in polyphonic music," *Computer Music Journal*, vol. 32, no. 3, pp. 72-86, fall 2008.

[42] Z. Duan and D. Temperley, "Note-level music transcription by maximum likelihood sampling," in *International Symposium on Music Information Retrieval Conference*, October 2001.

[43] M. Marolt, A. Kavcic, and M. Privosnik, "Neural networks for note onset detection in piano music," in *Proc. International Computer Music Conference,* 2002, Conference Proceedings.

[44] G. Costantini, R. Perfetti, and M. Todisco, "Event based transcription system for polyphonic piano music," *Signal Processing*, vol. 89, no. 9, pp. 1798-1811, 2009.

[45] A. Cogliati and Z. Duan, "Piano music transcription modeling note temporal evolution," in *Proc. of the IEEE International Conference on Acoustics, Speech, and Signal Processing* (*ICASSP*), Brisbane, Australia, 2015, pp. 429-433.

[46] H. Kameoka, T. Nishimoto, and S. Sagayama, "A multipitch analyzer based on harmonic temporal structured clustering," *IEEE Transactions on Audio, Speech, and Language Processing*, vol. 15, no. 3, pp. 982-994, 2007.

[47] T. Berg-Kirkpatrick, J. Andreas, and D. Klein, "Unsupervised transcription of piano music," in *Advances in Neural Information Processing Systems,* 2014, pp. 1538-1546.

[48] S. Ewert, M. D. Plumbley, and M. Sandler, "A dynamic programming variant of non-negative matrix deconvolution for the transcription of struck string instruments," in *Proc. of the IEEE International Conference on Acoustics, Speech, and Signal Processing* (*ICASSP*), Brisbane, Australia, 2015, pp. 569-573.

[49] S. S. Chen, D. L. Donoho, and M. A. Saunders, "Atomic decomposition by basis pursuit," *SIAM Journal on Scientific Computing*, vol. 20, no. 1, pp. 33-61, 1998.

[50] M. D. Zeiler, D. Krishnan, G. W. Taylor, and R. Fergus, "Deconvolutional networks," in *IEEE Conference on Computer Vision and Pattern Recognition* (*CVPR*), 2010, pp. 2528-2535.

[51] B. Wohlberg, "Efficient algorithms for convolutional sparse representations," *IEEE Transactions on Image Processing,* 2015.

[52] T. Blumensath and M. Davies, "Sparse and shift-invariant representations of music," *Audio, Speech, and Language Processing, IEEE Transactions on*, vol. 14, no. 1, pp. 50-57, 2006.

[53] R. Grosse, R. Raina, H. Kwong, and A. Y. Ng, "Shift-invariance sparse coding for audio classification," *arXiv preprint arXiv:* 1206.5241, 2012.

[54] M. Zeiler, D. Krishnan, G. Taylor, and R. Fergus, "Deconvolutional networks," in *Computer Vision and Pattern Recognition* (*CVPR*), 2010 *IEEE Conference on*, June 2010, pp. 2528-2535.

[55] B. Wohlberg, "Efficient convolutional sparse coding," in *Proc. of IEEE International Conference on Acoustics, Speech, and Signal Processing* (*ICASSP*), Florence, Italy, May 2014, pp. 7173-7177.

[56] S. Boyd, N. Parikh, E. Chu, B. Peleato, and J. Eckstein, "Distributed optimization and statistical learning via the alternating direction method of multipliers," *Foundations and Trends in Machine Learning*, vol. 3, no. 1, pp. 1-122, 2011.

[57] H. Bristow, A. Eriksson, and S. Lucey, "Fast convolutional sparse coding," in *Computer Vision and Pattern Recognition* (*CVPR*), 2013 *IEEE Conference on,* 2013, pp. 391-398.

[58] B. Wohlberg, "SParse Optimization Research COde (SPORCO)," Matlab library available from http://math.lanl.gov/~brendt/Software/SPORCO/, 2015, version 0.0.2.

[59] H. Suzuki and I. Nakamura, "Acoustics of pianos," *Applied Acoustics*, vol. 30, no. 2, pp. 147-205, 1990. [Online]. Available: http://www.sciencedirect.com/science/article/pii/0003682X9090043T.

[60] P.-K. Jao, Y.-H. Yang, and B. Wohlberg, "Informed monaural source separation of music based on convolutional sparse coding," in *Proc. of IEEE International Conference on Acoustics, Speech, and Signal Processing* (*ICASSP*), Brisbane, Australia, April 2015, pp. 236-240.

[61] M. Davy and A. Klapuri, *Signal Processing Methods for Music Transcription*. Springer, 2006.

What is claimed is:

1. A method of transcribing a musical performance played on a piano, the method comprising:

generating a waveform dictionary for use with the piano playing the musical performance, the waveform dictionary being generated in a supervised manner by recording a plurality of waveforms in a non-transitory computer-readable storage medium, each of the plurality of waveforms being associated with a key of the piano;

recording the musical performance played on the piano;

determining a plurality of activation vectors associated with the recorded performance using the plurality of recorded waveforms, each of the plurality of activation vectors corresponding to a key of the piano and comprising one or more activations of the corresponding key over time by using a computer processor;

detecting local maxima from the plurality of activation vectors by using said computer processor;

inferring note onsets from the detected local maxima by using said computer processor;

outputting the inferred note onsets and the determined plurality of activation vectors by using said computer processor.

2. The method of claim 1, wherein the plurality of recorded waveforms are associated with each individual piano note of the piano.

3. The method of claim 1, wherein the plurality of recorded waveforms each have a duration of 0.5 second or more.

4. The method of claim 1, wherein the plurality of activation vectors are determined using a convolutional sparse coding algorithm.

5. The method of claim 1, wherein detecting local maxima from the plurality of activation vectors comprises discarding subsequent maxima following an initial local maxima that are within a predetermined time window.

6. The method of claim 5, wherein the predetermined time window is at least 50 ms.

7. The method of claim 1, wherein detecting local maxima from the plurality of activation vectors comprises discarding local maxima that are below a threshold that is associated with a highest peak in the plurality of activation vectors.

8. The method of claim 7, wherein the threshold is 10% of the highest peak in the plurality of activation vectors such that local maxima that are 10% or less than the highest peak in the plurality of activation vectors are discarded.

9. A system for transcribing a musical performance played on a piano, the system comprising:

an audio recorder for recording a plurality of waveforms associated with keys of the piano and for recording the musical performance played on the piano;

a non-transitory computer-readable storage medium operably coupled with the audio recorder for storing the plurality of waveforms associated with keys of the piano to form a dictionary of elements and for storing the musical performance played on the piano;

a computer processor operably coupled with the non-transitory computer-readable storage medium and configured to:

determine a plurality of activation vectors associated with the stored performance using the plurality of stored waveform, each of the plurality of activation vectors corresponding to a key of the piano and comprising one or more activations of the corresponding key over time s;

detect local maxima from the plurality of activation vectors;

infer note onsets from the detected local maxima; and output the inferred note onsets and the determined plurality of activation vectors.

10. The system of claim 9, wherein the plurality of stored waveforms are associated with all individual piano notes of the piano.

11. The system of claim 9, wherein the plurality of stored waveforms each have a duration of one second or more.

12. The system of claim 9, wherein the plurality of activation vectors are determined by the computer processor using a convolutional sparse coding algorithm.

13. The system of claim 9, wherein the computer processor detects local maxima from the plurality of activation vectors by discarding subsequent maxima following an initial local maxima that are within a predetermined time window.

14. The system of claim 13, wherein the predetermined time window is at least 50 ms.

15. The system of claim 9, wherein the computer processor detects local maxima from the plurality of activation vectors by discarding local maxima that are below a threshold that is associated with a highest peak in the plurality of activation vectors.

16. The system of claim 15, wherein the threshold is 10% of the highest peak in the plurality of activation vectors such that local maxima that are 10% or less than the highest peak in the plurality of activation vectors are discarded.

17. A non-transitory computer-readable storage medium comprising a set of computer executable instructions for transcribing a musical performance played on an instrument, wherein execution of the instructions by a computer processor causes the computer processor to carry out the steps of:

generating a waveform dictionary for use with the piano playing the musical performance, the waveform dictionary being trained in a supervised manner by recording a plurality of waveforms in a non-transitory computer-readable storage medium, each of the plurality of waveforms being associated with a key of the instrument;

recording the musical performance played on the instrument;

determining a plurality of activation vectors associated with the recorded performance using the plurality of recorded waveforms, each of the plurality of activation vectors corresponding to a key of the piano and comprising one or more activations of the corresponding key over time;

detecting local maxima from the plurality of activation vectors;

inferring note onsets from the detected local maxima;

outputting the inferred note onsets and the determined plurality of activation vectors.

18. The non-transitory computer-readable storage medium of claim 17, wherein the plurality of activation vectors are determined using a convolutional sparse coding algorithm.

19. The non-transitory computer-readable storage medium of claim 17, wherein detecting local maxima from the plurality of activation vectors comprises discarding local maxima that are below a threshold that is associated with a highest peak in the plurality of activation vectors.

20. The non-transitory computer-readable storage medium of claim 17, wherein detecting local maxima from the plurality of activation vectors comprises discarding subsequent maxima following an initial local maxima that are within a predetermined time window.

* * * * *